US007263919B2

(12) United States Patent
Arnold

(10) Patent No.: US 7,263,919 B2
(45) **Date of Patent: *Sep. 4, 2007**

(54) RATCHETING TOOL WITH VERTICALLY CURVED TOOTH ARRANGEMENT

(75) Inventor: Robert L. Arnold, Wrightsville, PA (US)

(73) Assignee: Easco Handtools, Inc., Simsbury, CT (US)

( * ) Notice: Subject to any disclaimer, the term of this patent is extended or adjusted under 35 U.S.C. 154(b) by 108 days.

This patent is subject to a terminal disclaimer.

(21) Appl. No.: 10/939,200

(22) Filed: Sep. 10, 2004

(65) Prior Publication Data

US 2006/0123954 A1 Jun. 15, 2006

(51) Int. Cl.
*B25B 13/46* (2006.01)

(52) U.S. Cl. ..... 81/63.2; 81/60; 81/63.1

(58) Field of Classification Search ..... 81/60–63.2
See application file for complete search history.

(56) References Cited

U.S. PATENT DOCUMENTS

| | | | |
|---|---|---|---|
| 893,097 | A | 7/1908 | Reams |
| 1,090,578 | A | 3/1914 | Smythe |
| 2,701,977 | A | 2/1955 | Stone |
| 2,725,772 | A | 12/1955 | Stone |
| 2,957,377 | A | 10/1960 | Hare |
| 3,393,780 | A | 7/1968 | Kilness |
| 3,436,992 | A | 4/1969 | Over et al. |
| 3,606,940 | A | 9/1971 | Finkeldei |
| 3,783,703 | A | 1/1974 | Trimble et al. |
| 3,866,492 | A | 2/1975 | Knoll |
| 4,497,227 | A | 2/1985 | Stasiek |
| 4,520,697 | A | 6/1985 | Moetteli |
| 4,762,033 | A | 8/1988 | Chow |
| 4,924,737 | A | 5/1990 | Gummow |
| 5,448,931 | A | 9/1995 | Fossella et al. |
| 5,467,672 | A | 11/1995 | Ashby |
| 5,495,783 | A | 3/1996 | Slusar et al. |
| 5,501,124 | A | 3/1996 | Ashby |
| 5,533,427 | A * | 7/1996 | Chow ..... 81/63.2 |
| 5,535,646 | A | 7/1996 | Allen et al. |
| 5,636,557 | A | 6/1997 | Ma |
| 5,884,537 | A | 3/1999 | Chen |
| 5,884,538 | A | 3/1999 | Van Lenten |
| 6,044,731 | A | 4/2000 | Hsieh |
| 6,065,374 | A | 5/2000 | Taggart |

(Continued)

OTHER PUBLICATIONS

U.S. Appl. No. 10/437,860, filed Nov. 1, 2002, Arnold et al.

(Continued)

*Primary Examiner*—Hadi Shakeri
(74) *Attorney, Agent, or Firm*—Nelson Mullins Riley & Scarborough, L.L.P.

(57) ABSTRACT

A ratcheting tool includes a body, a compartment defined by the body, a gear rotatably disposed in the compartment, and a pawl. The pawl, disposed within the tool, selectively prevents the tool from rotating in one direction while allowing rotation in the opposite direction. The gear defines a plurality of vertically curved teeth. The pawl defines a plurality of vertically curved teeth. The pawl teeth are curved in a manner that mates with the gear teeth. A radius of curvature of the edges of the gear teeth is greater than the radius of curvature of the edges of the pawl teeth.

26 Claims, 30 Drawing Sheets

U.S. PATENT DOCUMENTS 6,134,990 A 10/2000 Ling et al.
6,148,695 A * 11/2000 Hu ..... 81/60
6,155,140 A 12/2000 Tsai
6,216,563 B1 4/2001 Hsieh
6,230,591 B1 5/2001 Ling et al.
6,282,992 B1 9/2001 Hu
6,431,030 B1 8/2002 Kuo et al.
6,435,063 B1 8/2002 Chen
6,450,066 B1 9/2002 Hu
6,457,387 B1 10/2002 Hu
6,457,388 B1 10/2002 Chen
6,655,238 B1 * 12/2003 Hsien ..... 81/60
6,732,614 B2 5/2004 Hu
2001/0054531 A1 12/2001 Chang
2002/0084163 A1 7/2002 Chen
2002/0166416 A1 11/2002 Hu
2004/0200322 A1 * 10/2004 Hu ..... 81/63.2

OTHER PUBLICATIONS

U.S. Appl. No. 10/437,860, filed May 14, 2003, Chaconas et al.

* cited by examiner

RATCHETING TOOL WITH VERTICALLY CURVED TOOTH ARRANGEMENT

BACKGROUND OF THE INVENTION

Ratcheting tools frequently include gear and pawl assemblies so that a gear may rotate in one direction but not rotate in the opposite direction. Typically, ratcheting tools employ a pawl on the inside or outside of the gear's diameter. The teeth of the gear and the pawl mesh together when the pawl is operatively disposed between the tool forging and the gear so that the forging prevents the pawl from moving away from the gear in one of the gear's rotational directions.

Several factors may contribute to the strength of the teeth, including depth, number, size, and shape of the teeth on the gear and the pawl. As shown in U.S. Pat. No. 5,636,557 to Ma, incorporated herein by reference, it is known to use arcuate pawl teeth.

Examples of ratcheting tools having a sliding pawl engaging the outer diameter of a ratchet gear are provided in U.S. Pat. Nos. 6,230,591 and 5,636,557, the entire disclosure of each of which is herein incorporated by reference.

SUMMARY OF THE INVENTION

The present invention recognizes and addresses considerations of prior art constructions and methods.

In one embodiment of a ratcheting tool according to the present invention, a ratcheting tool includes a body, a compartment defined by the body, a gear rotatably disposed in the compartment, and a pawl. The gear defines a plurality of teeth having respective edges aligned generally parallel to an axis, and the gear is rotatably disposed in the compartment about the axis. The pawl has a plurality of teeth with respective edges aligned generally parallel to the axis and facing the gear so that the gear teeth and the pawl teeth are engagable with each other at an engagement area of the gear teeth and an engagement area of the pawl teeth. The pawl is disposed between the gear and the body so that the body transmits torque through the pawl in a first rotational direction and so that the pawl ratchets with respect to the gear in a second rotational direction. The edges of one of the gear teeth and the pawl teeth are concave at one of the engagement area of the gear teeth and the engagement area of the pawl teeth, and the edges of the other of the gear teeth and the pawl teeth are convex at the other of the engagement area of the gear teeth and the engagement area of the pawl teeth. A radius of curvature of the concave edges of the one of the gear teeth and the pawl teeth is greater than a radius of curvature of the convex edges of the other of the gear teeth and the pawl teeth.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
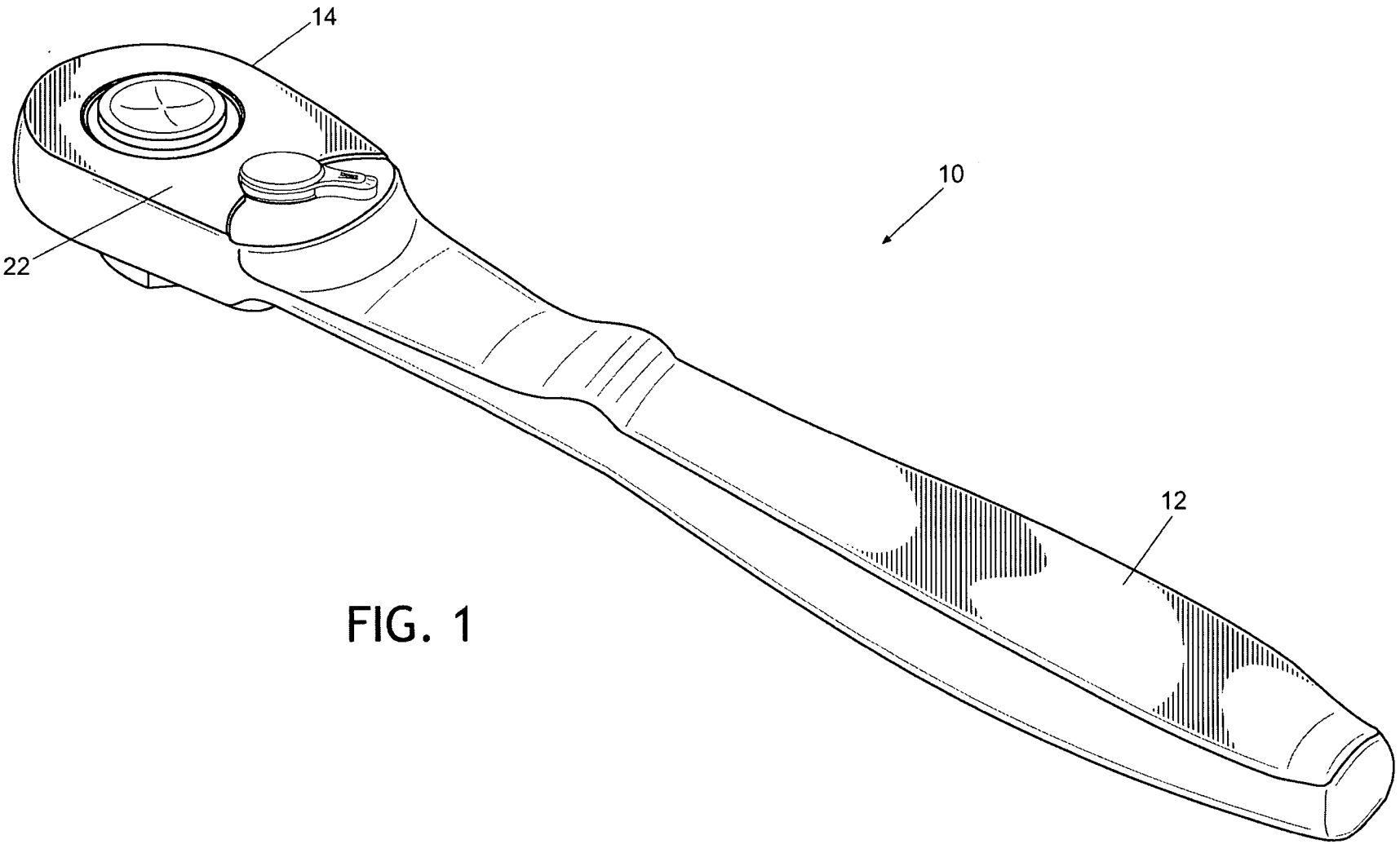
FIG. 1 is a perspective view of a ratcheting tool in accordance with an embodiment of the present invention.
Figure 4A:
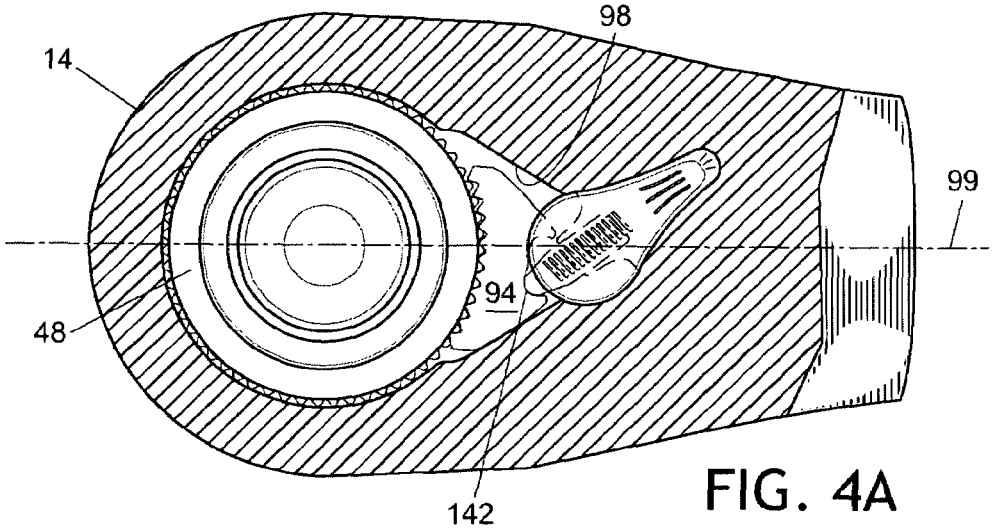
Figure 4B:
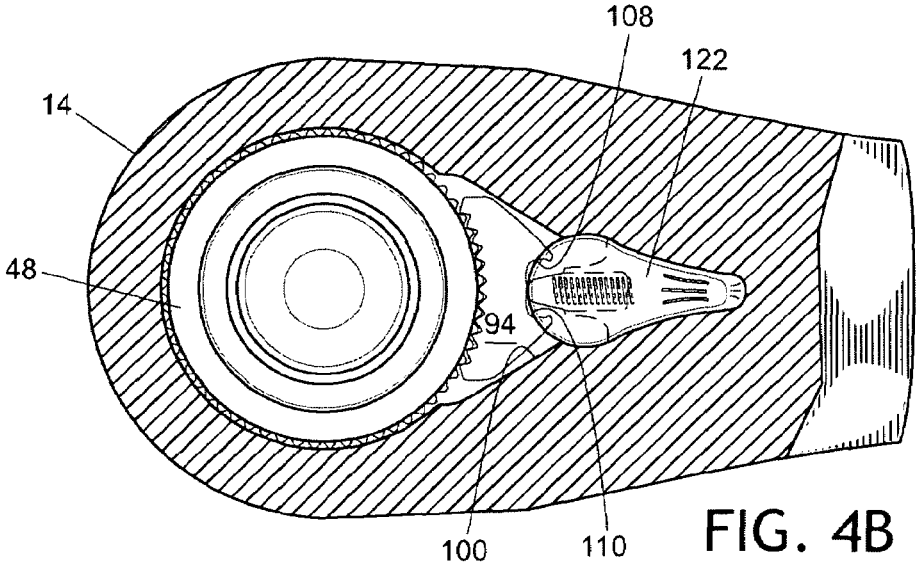
Figure 4C:
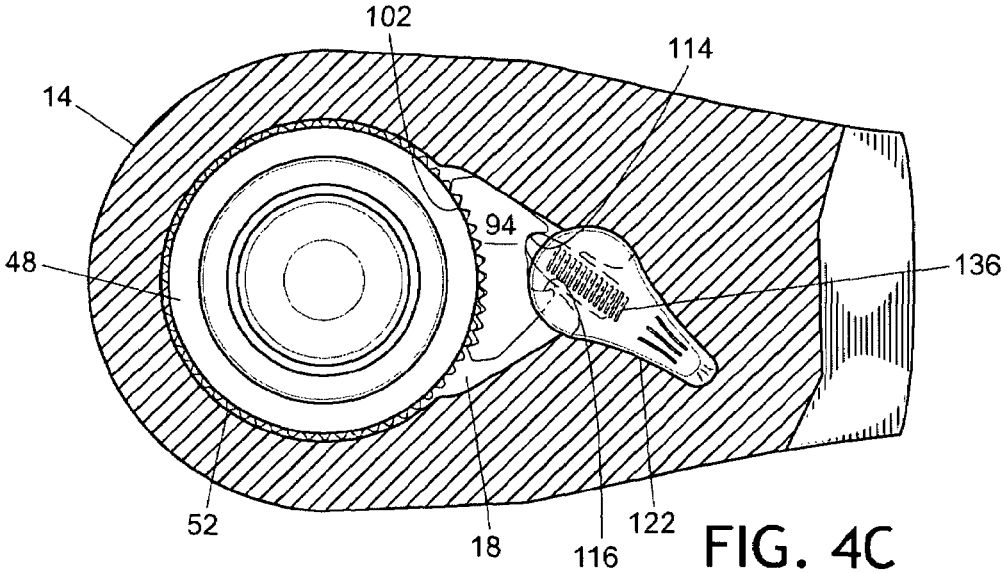
Figure 5A:
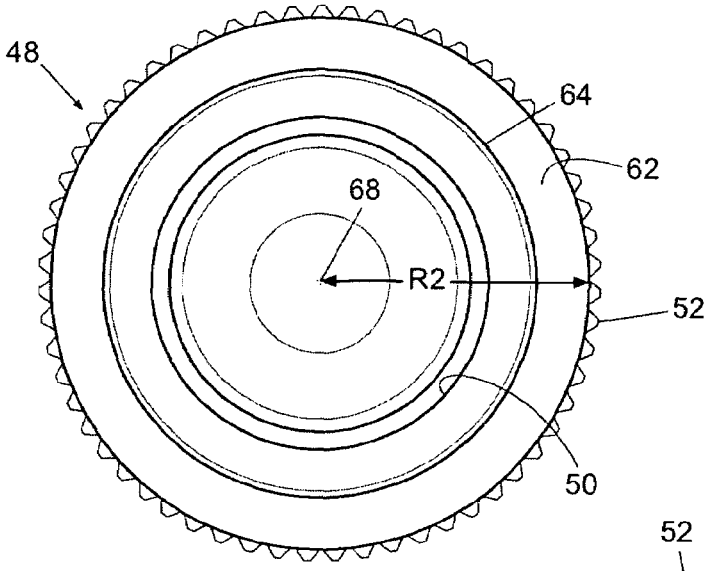
Figure 5B:
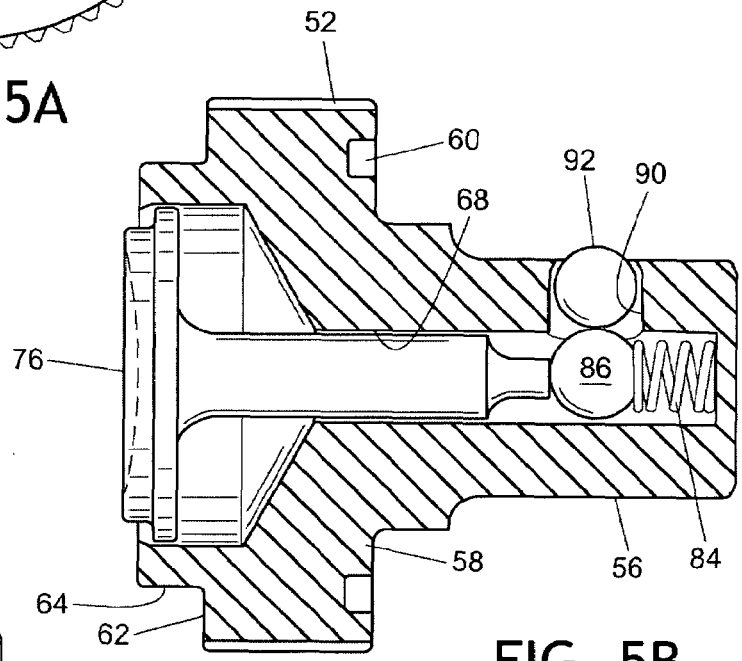
Figure 5C:
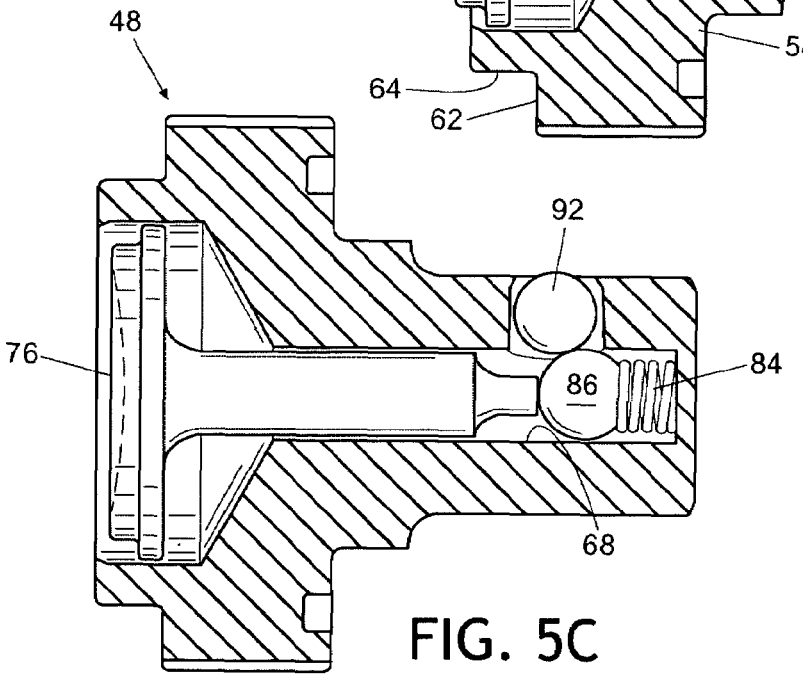
Figure 6:
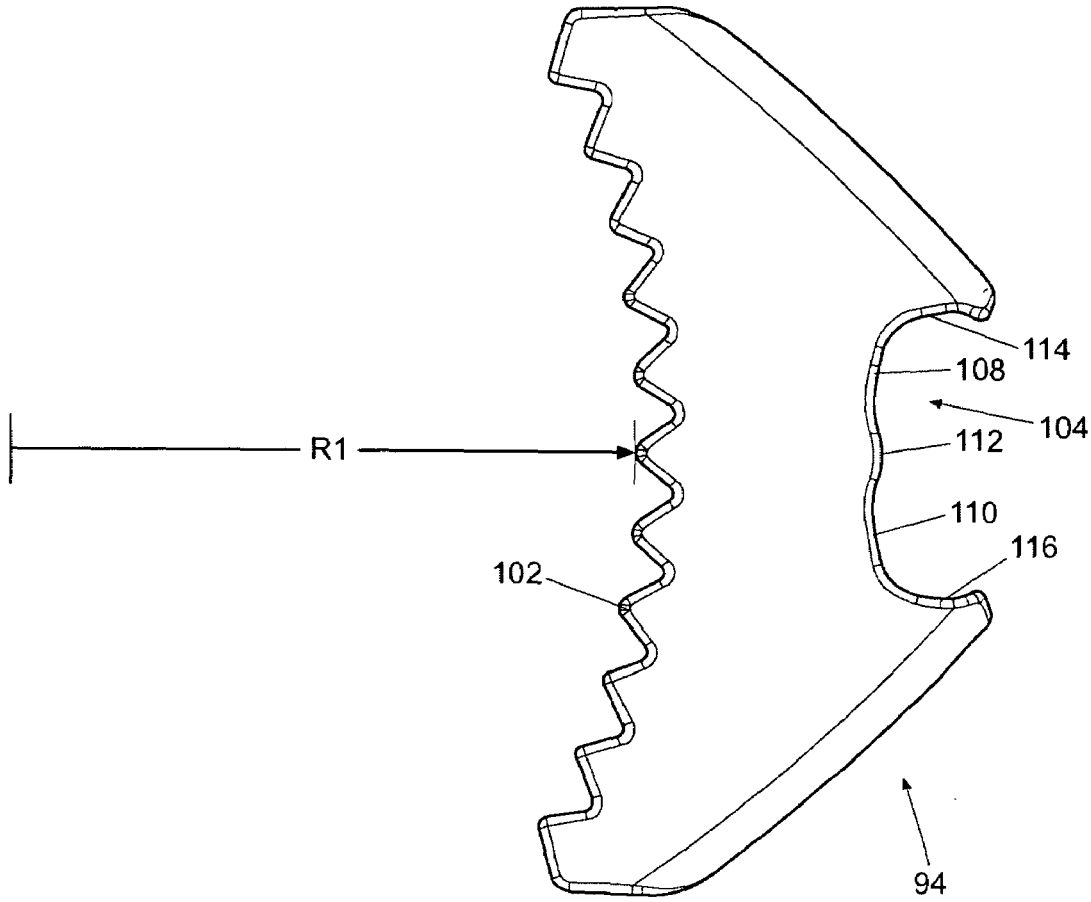
Figure 7:
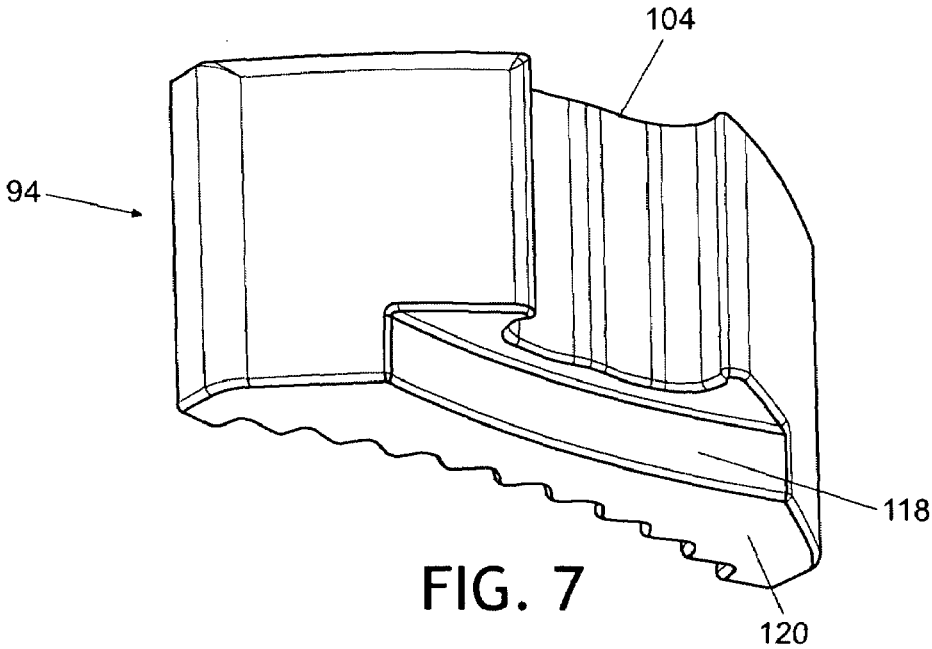
Figure 8:
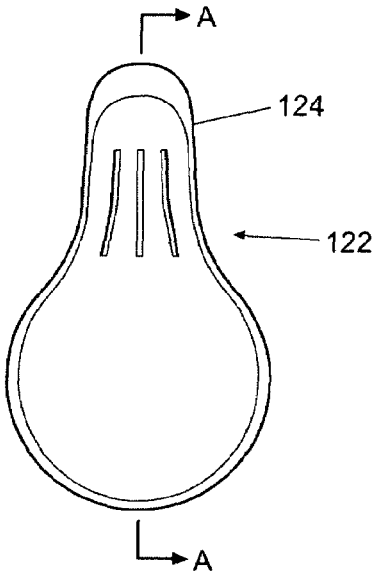
Figure 9:
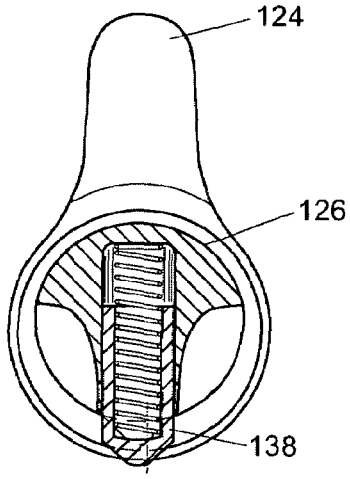
Figure 8A:
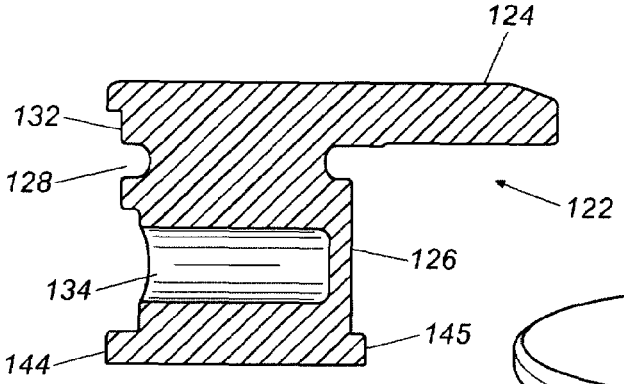
Figure 10:
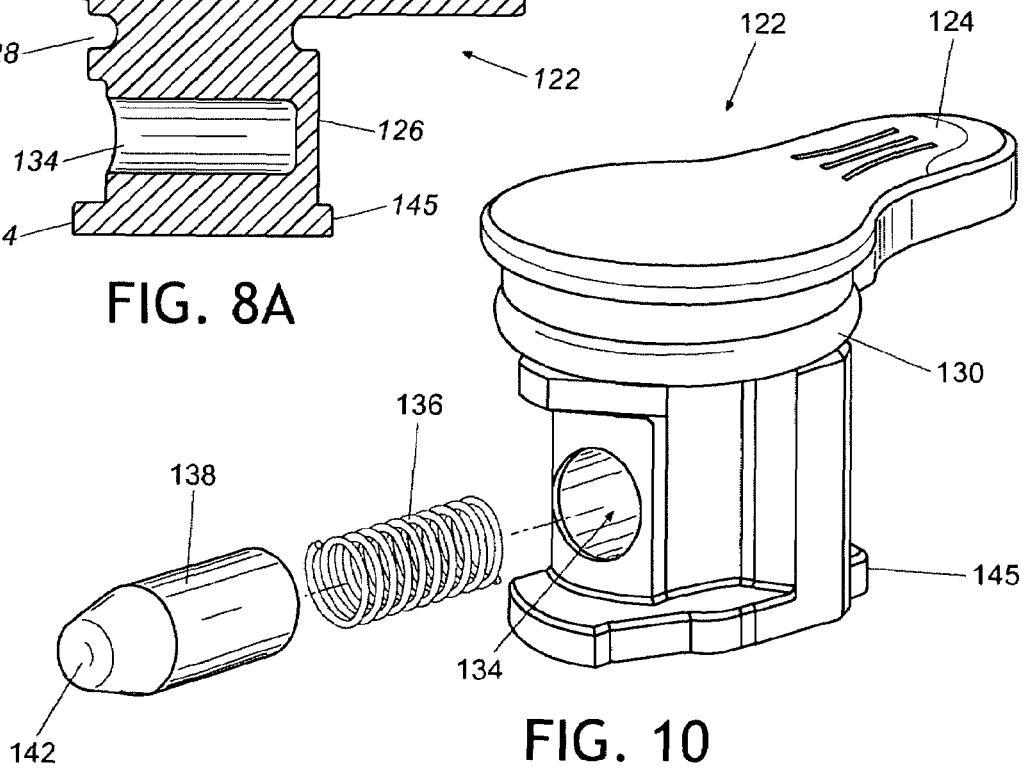
Figure 11:
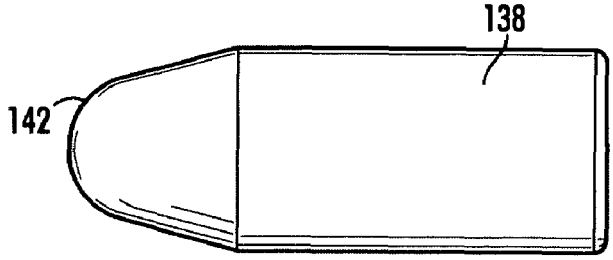
Figure 11A:
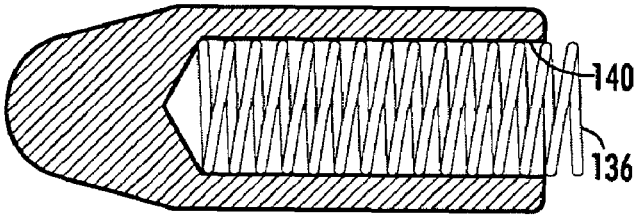
Figure 12:
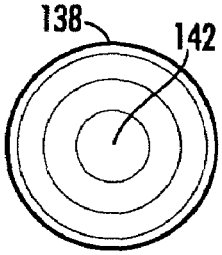
Figure 13:
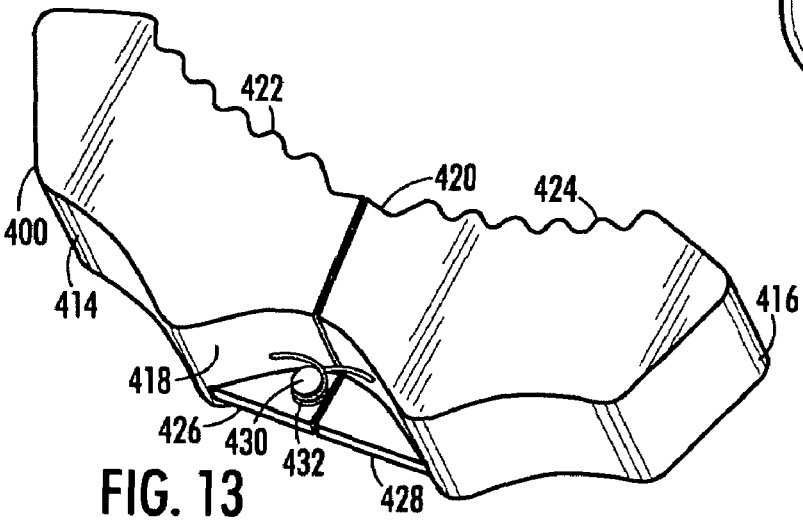
Figure 13A:
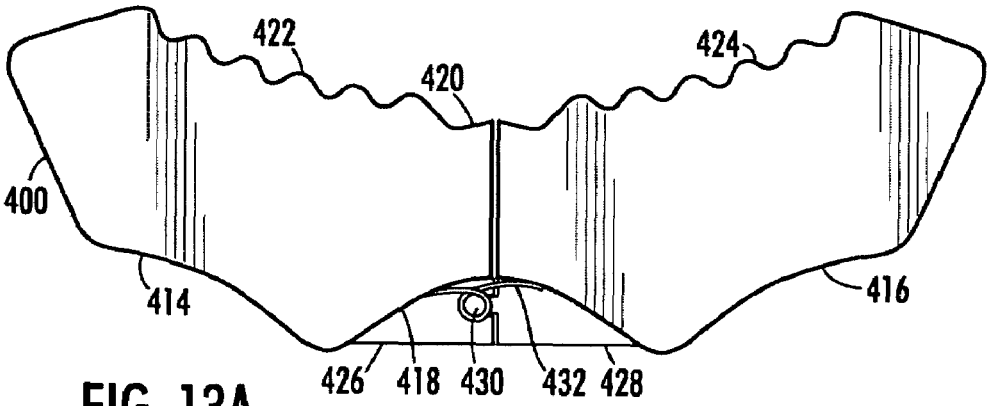
Figure 14A:
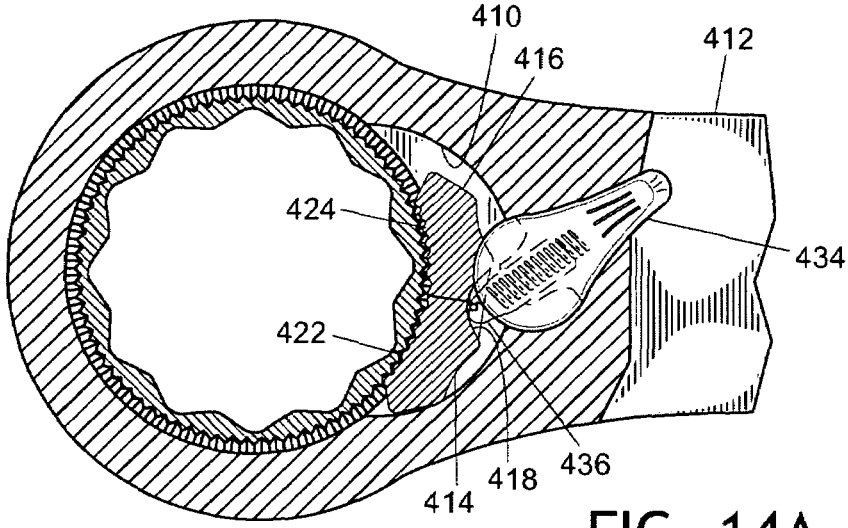
Figure 14B:
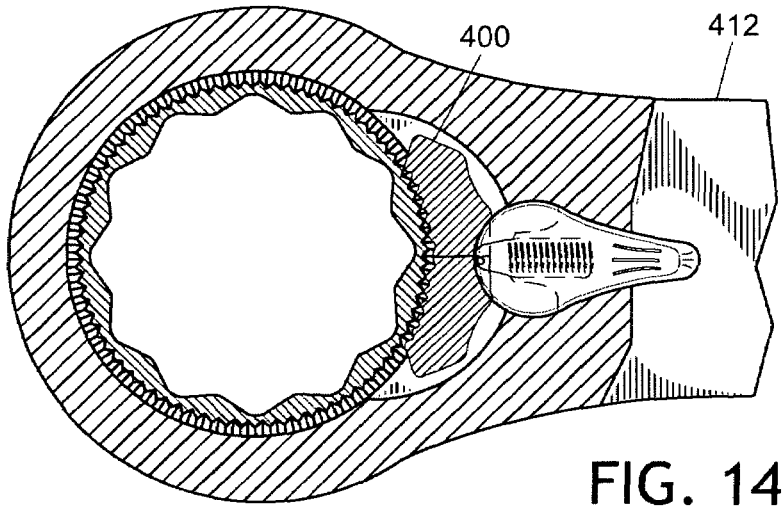
Figure 14C:
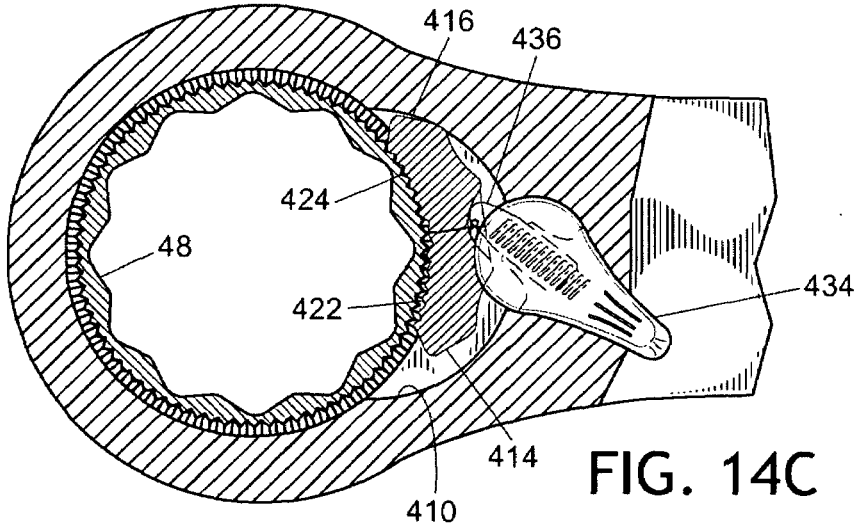
Figure 15A:
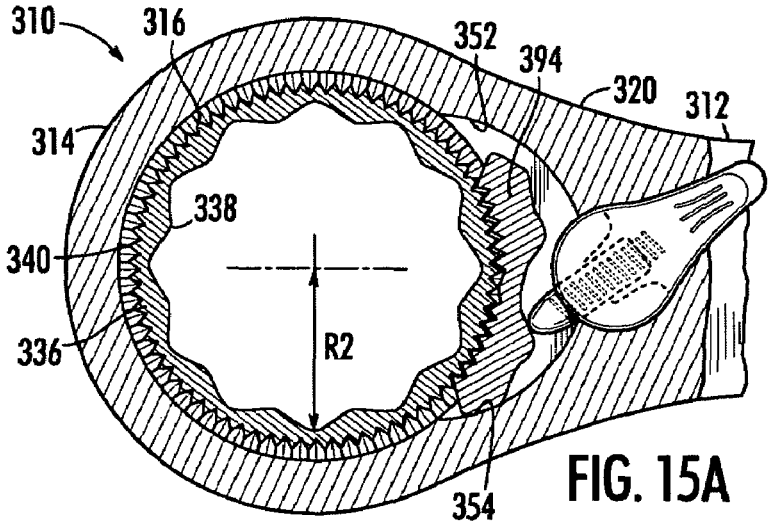
Figure 15B:
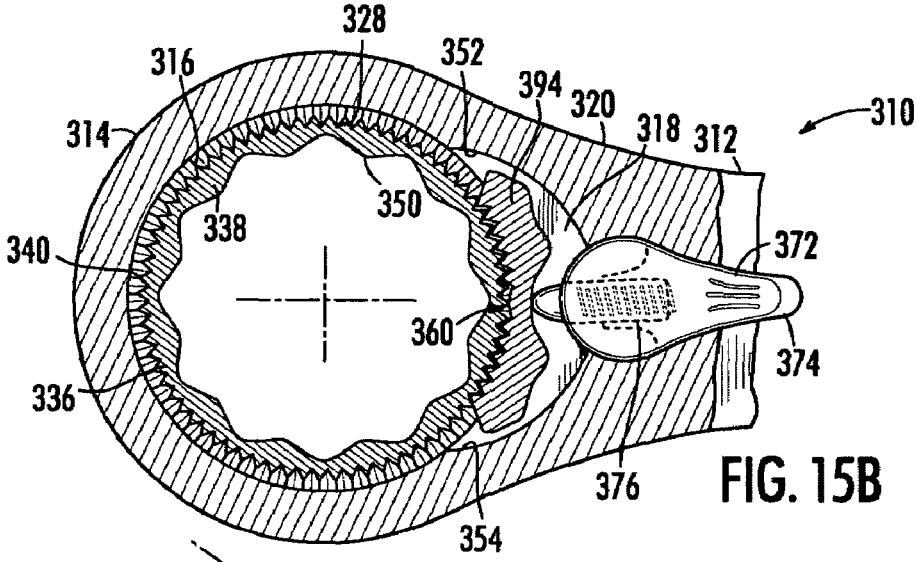
Figure 15C:
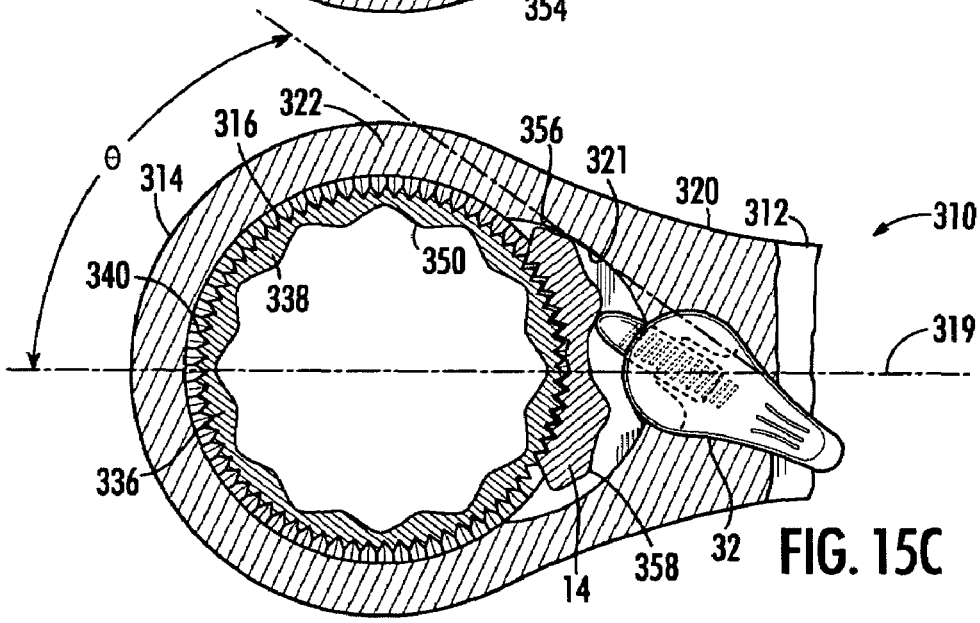
Figure 15D:
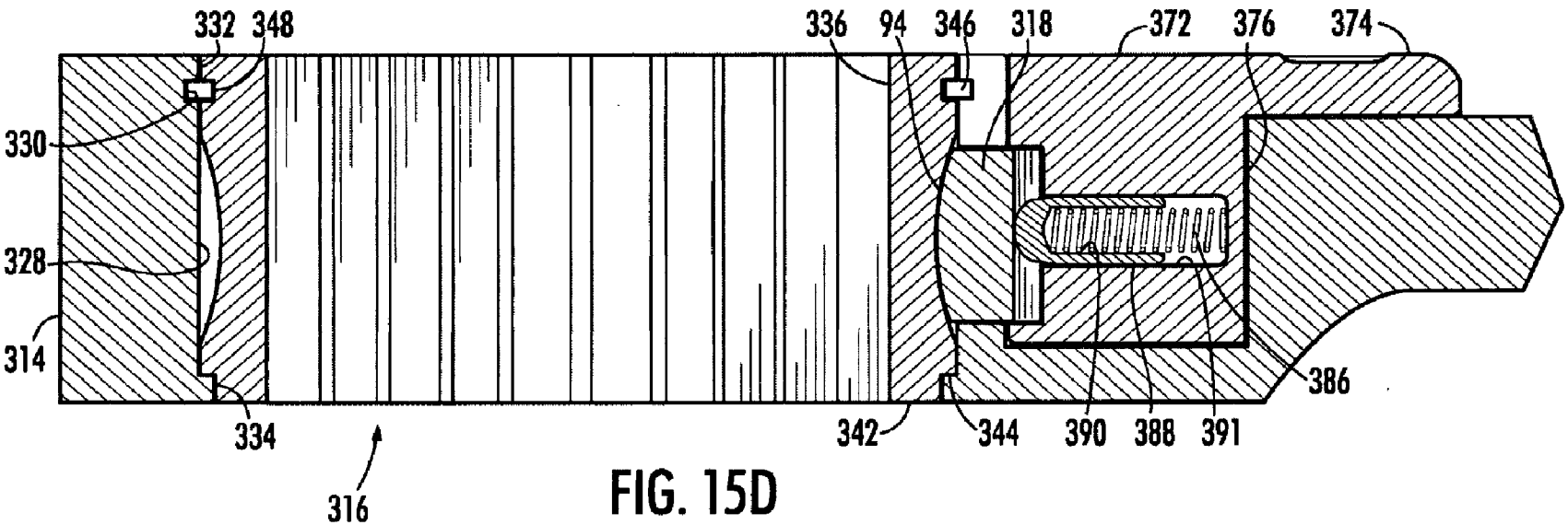
Figure 15E:
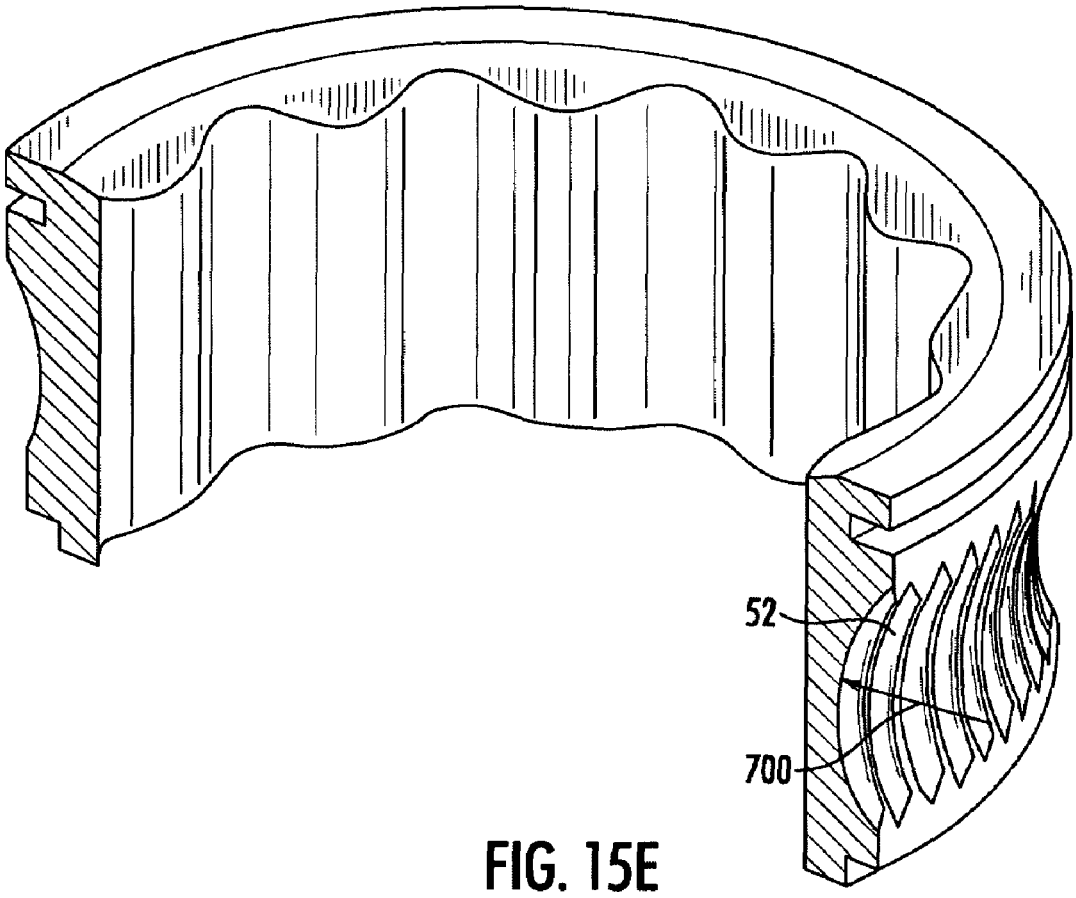
Figure 15F:
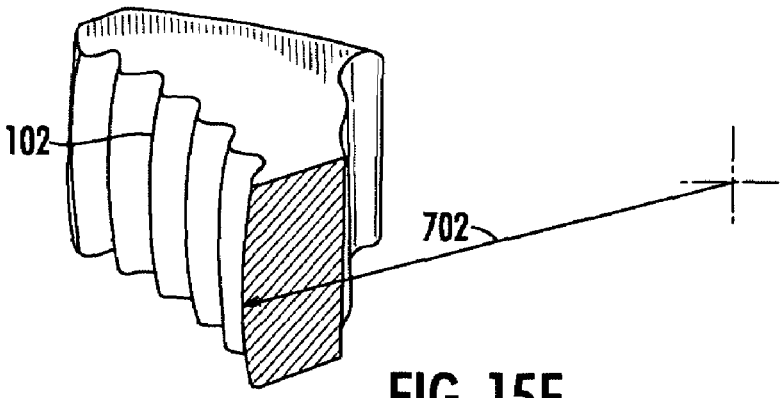
Figure 16A:
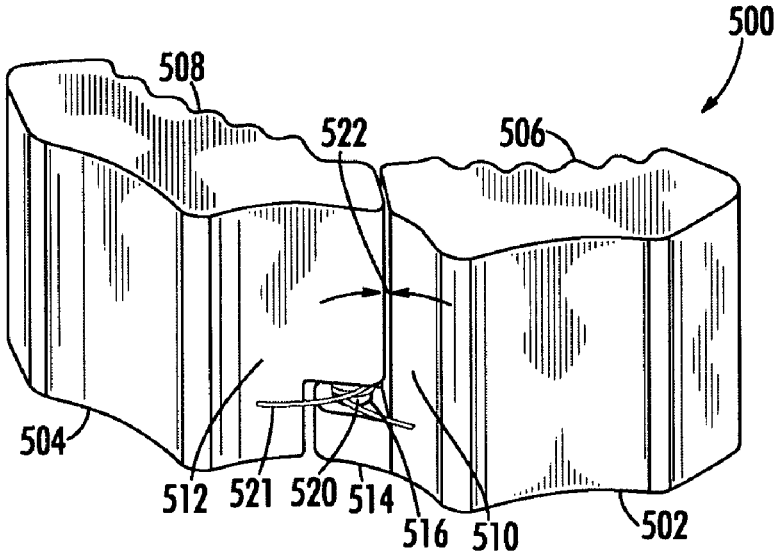
Figure 16B:
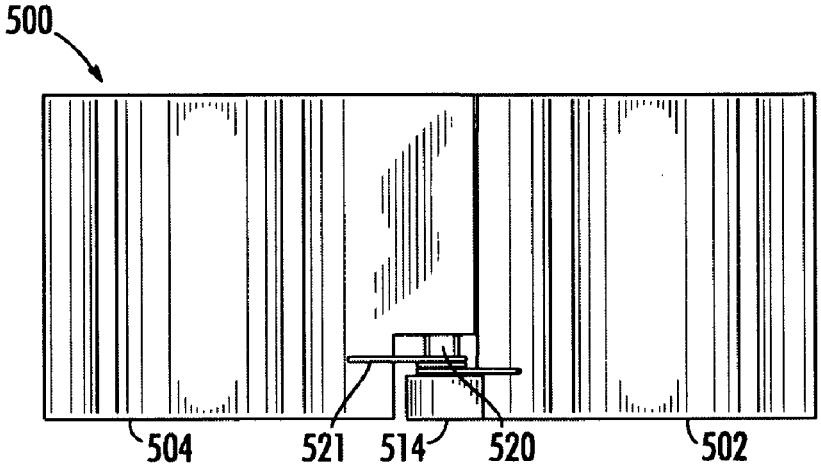
Figure 16C:
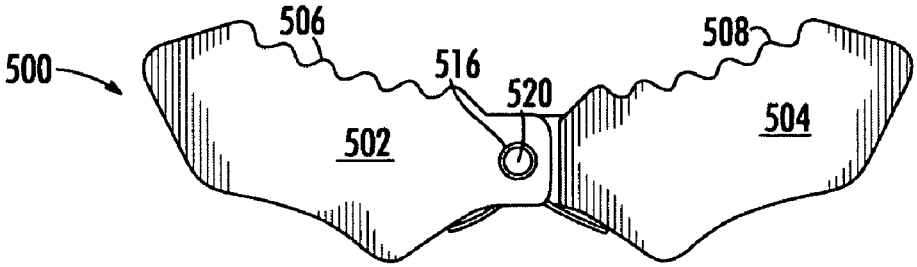
Figure 17:
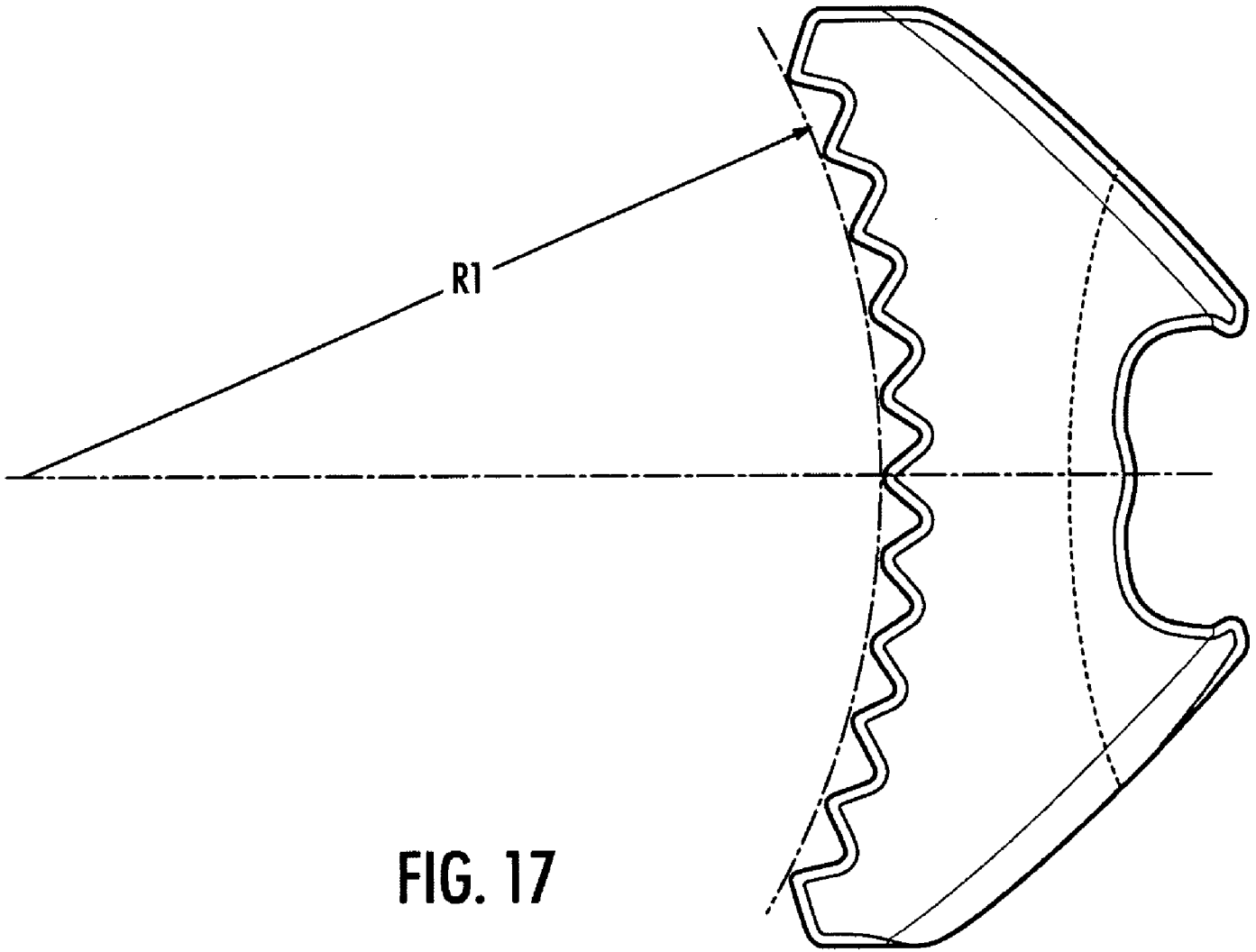
Figure 18:
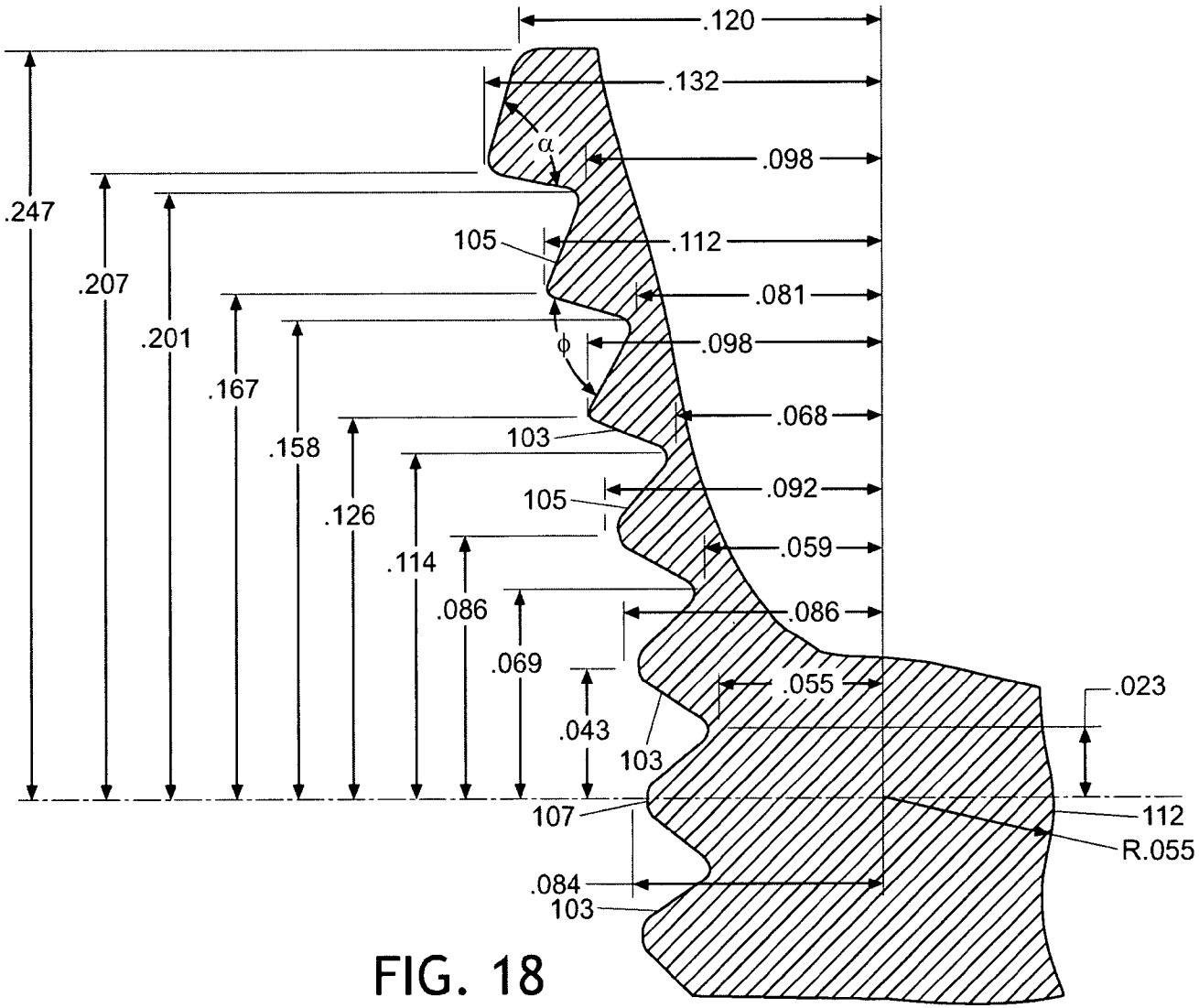
Figure 19:
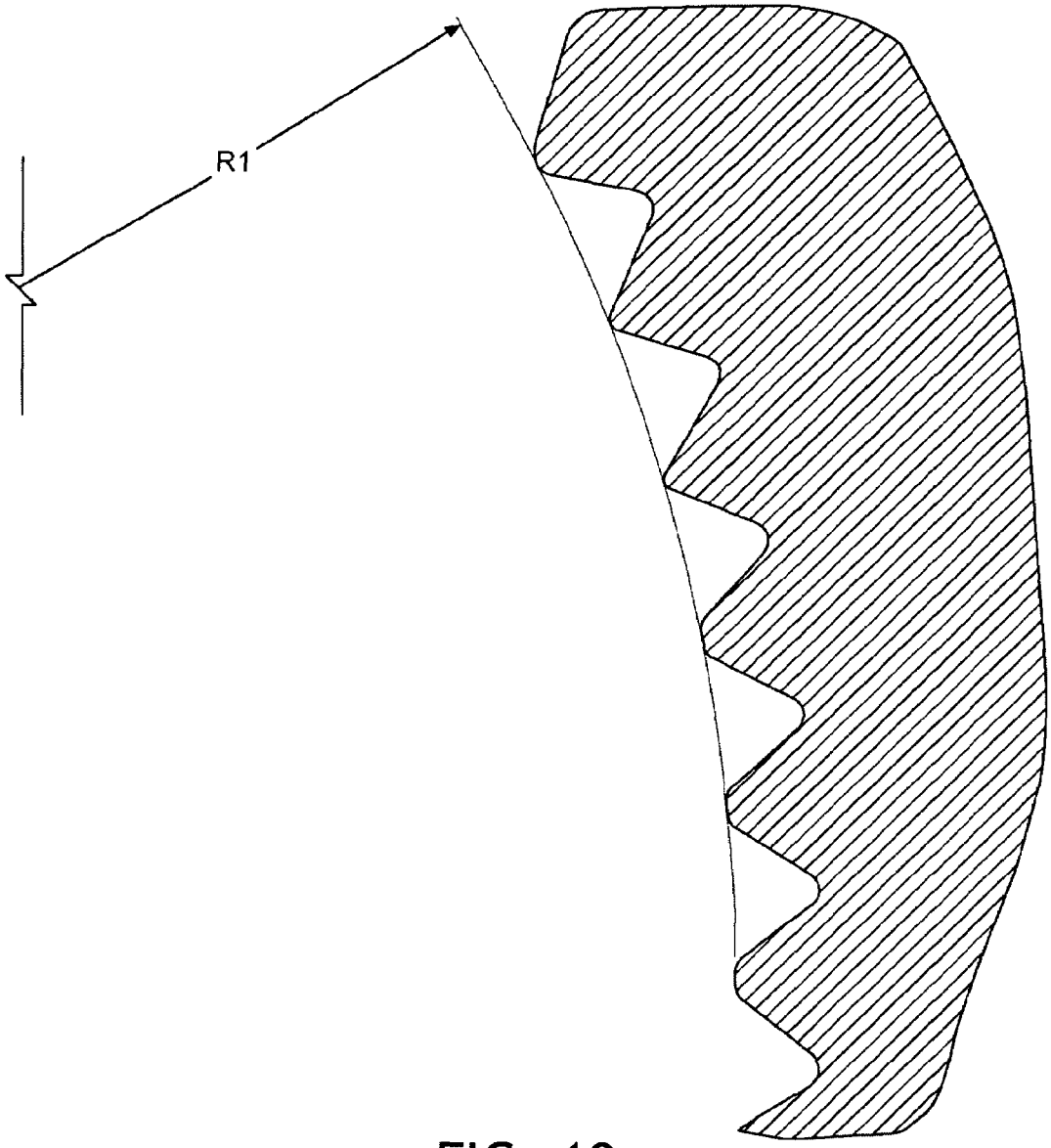
Figure 20:
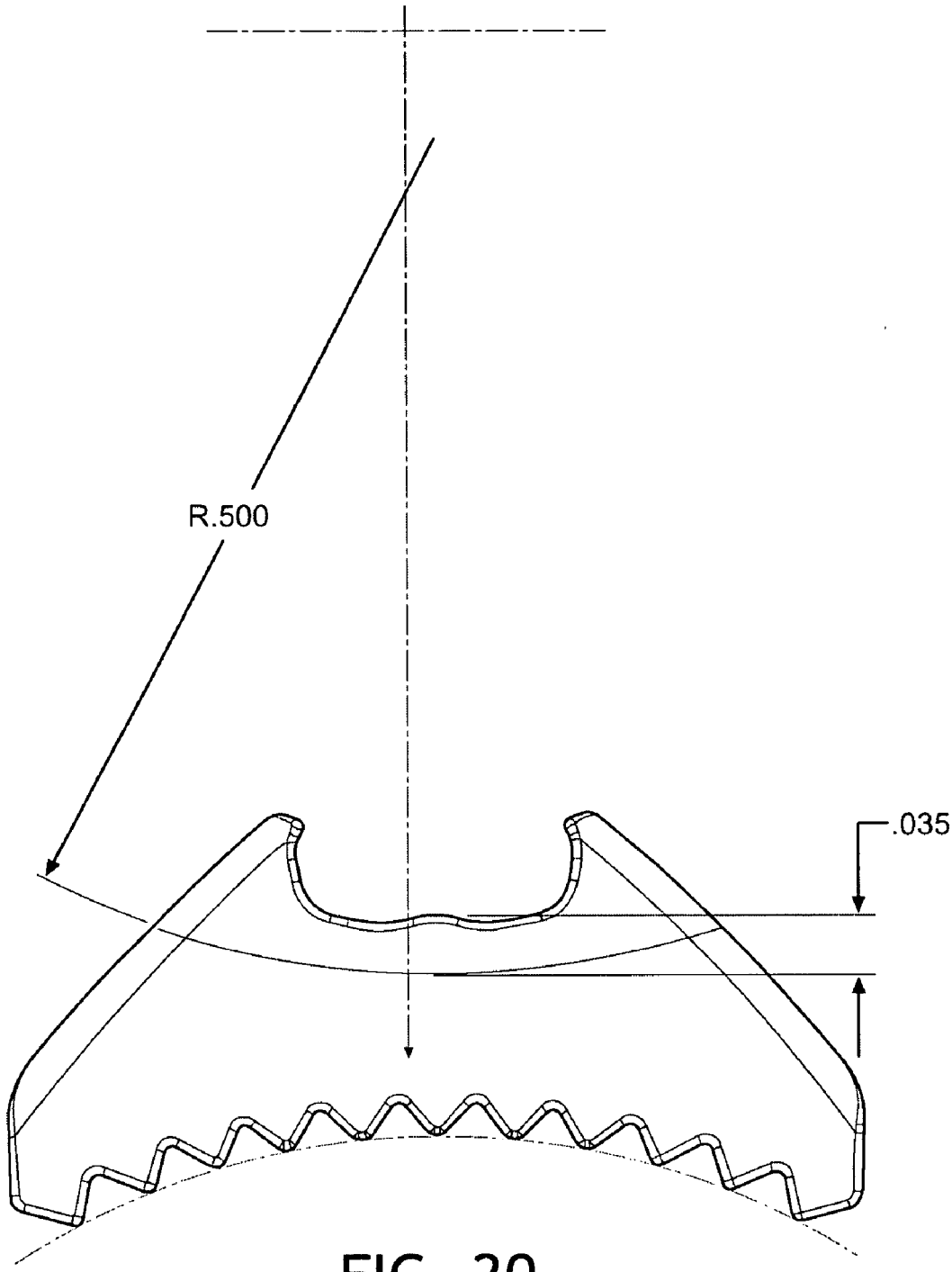
Figure 21:
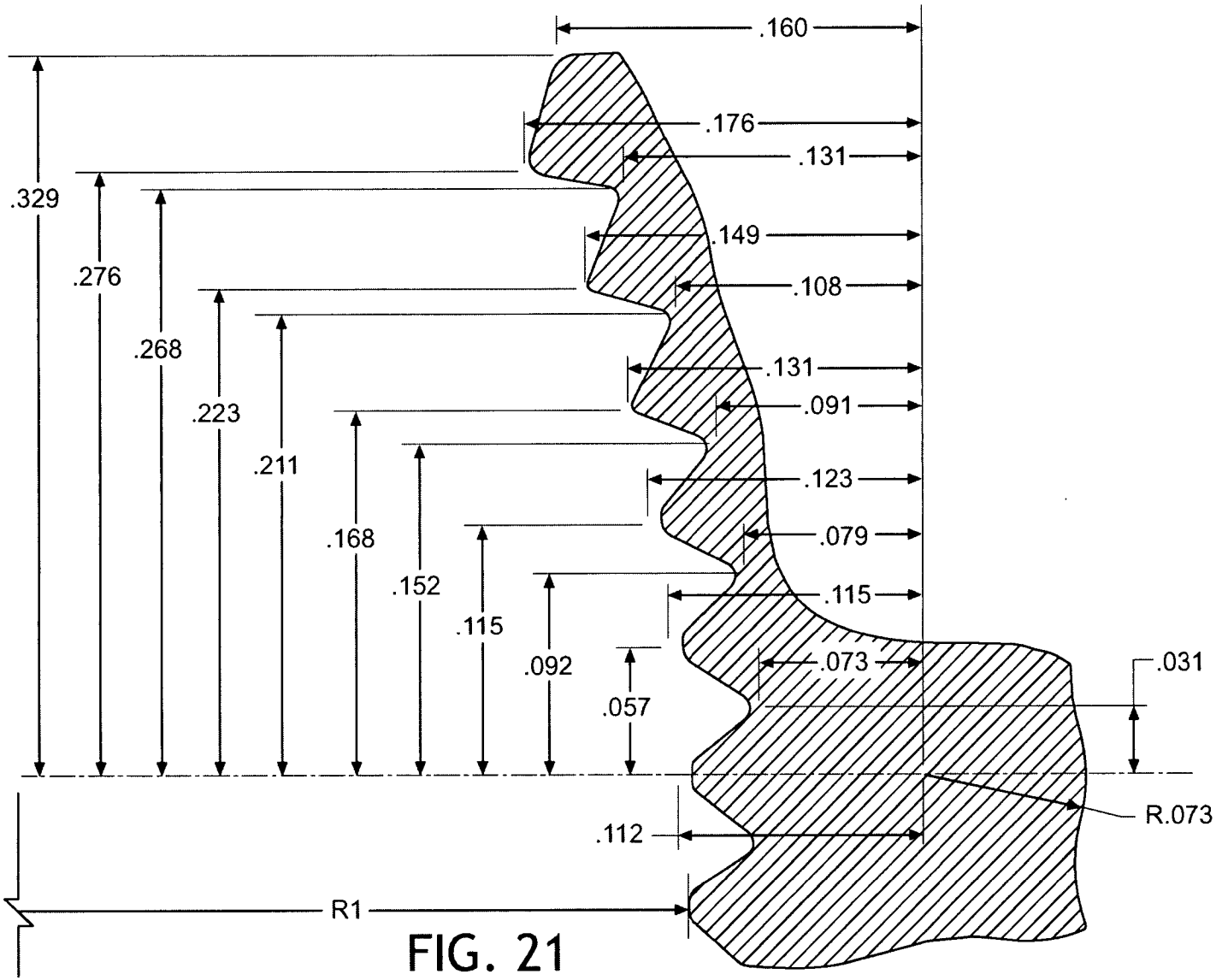
Figure 22:
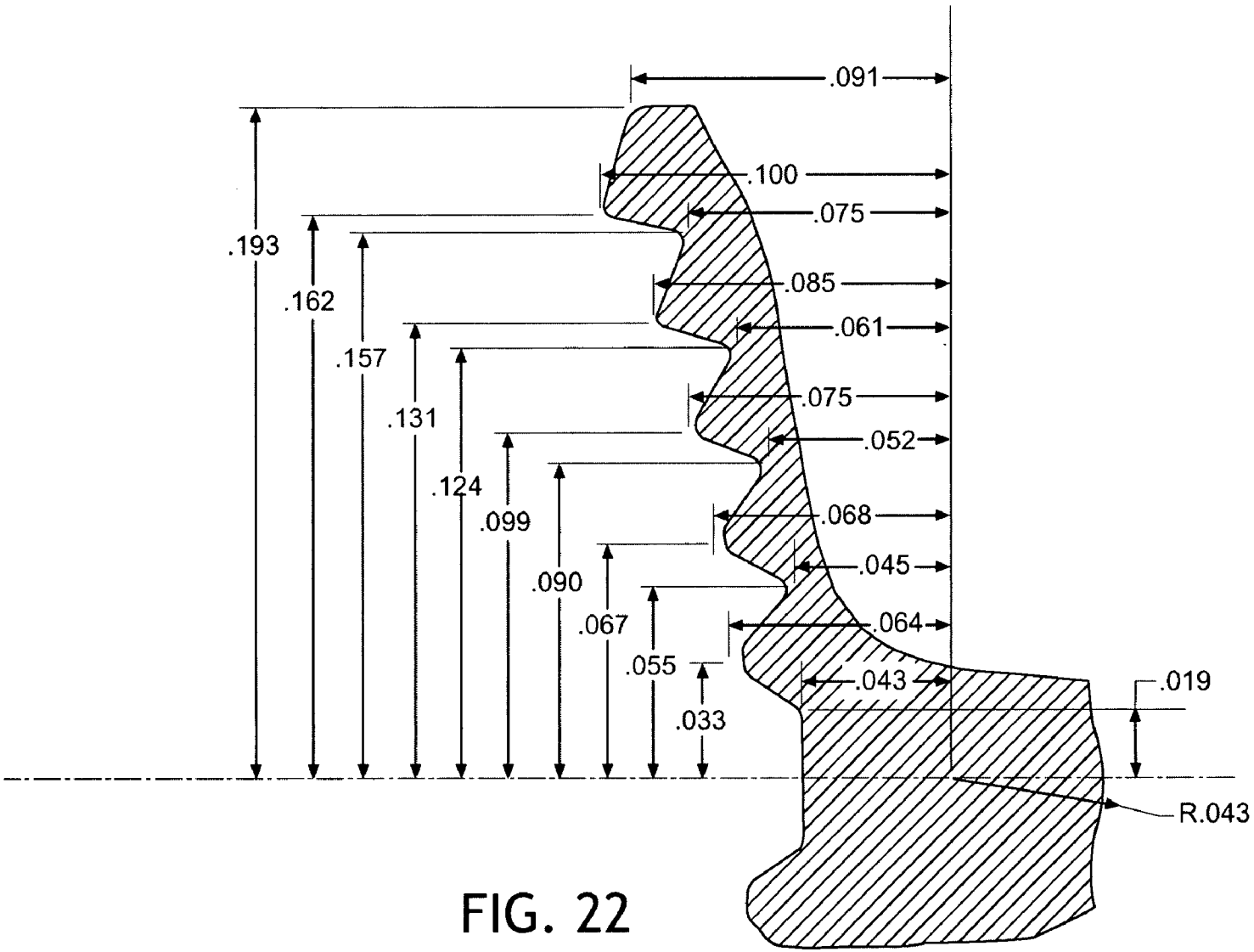
Figure 23:
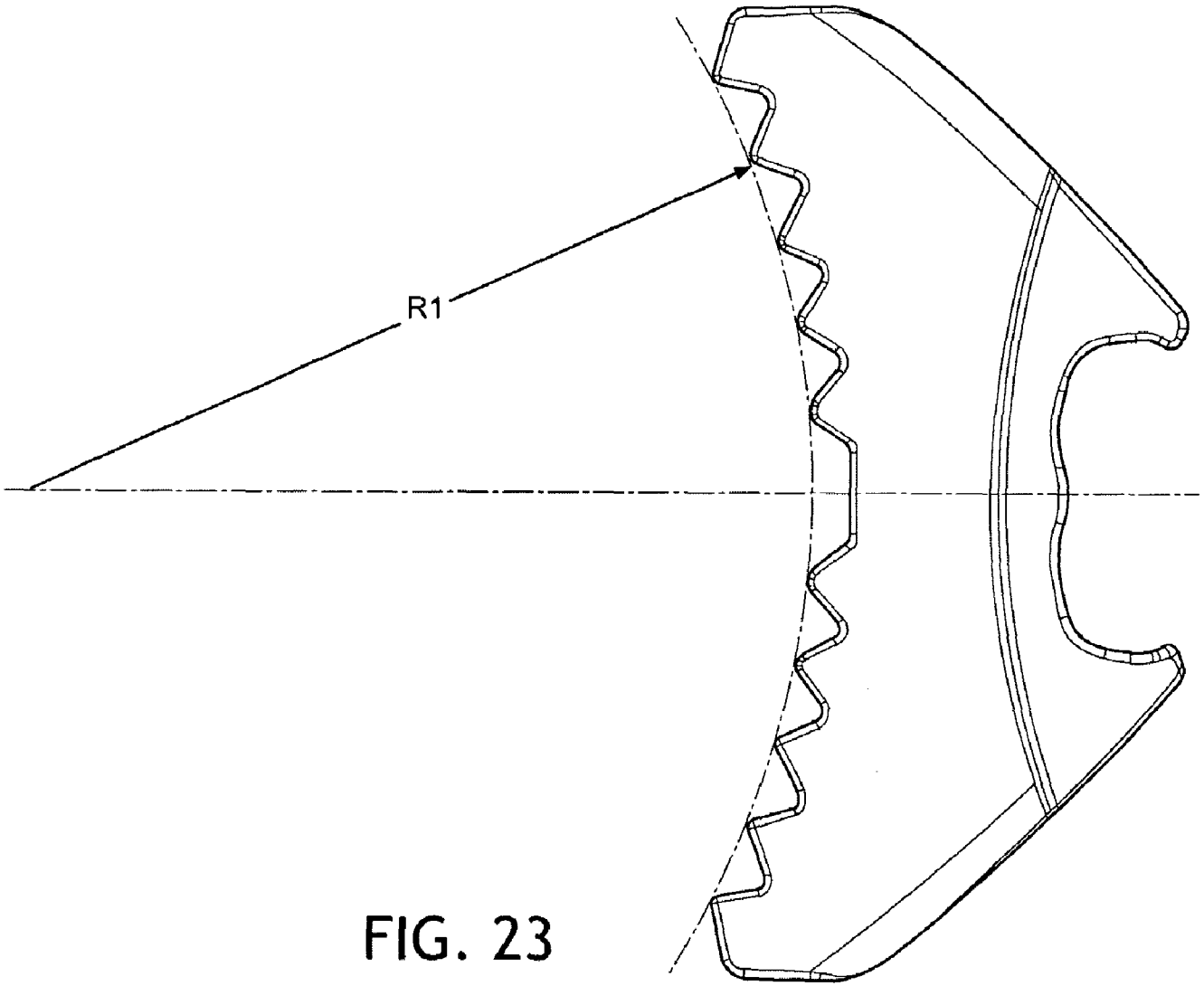
Figures 24, 24A:
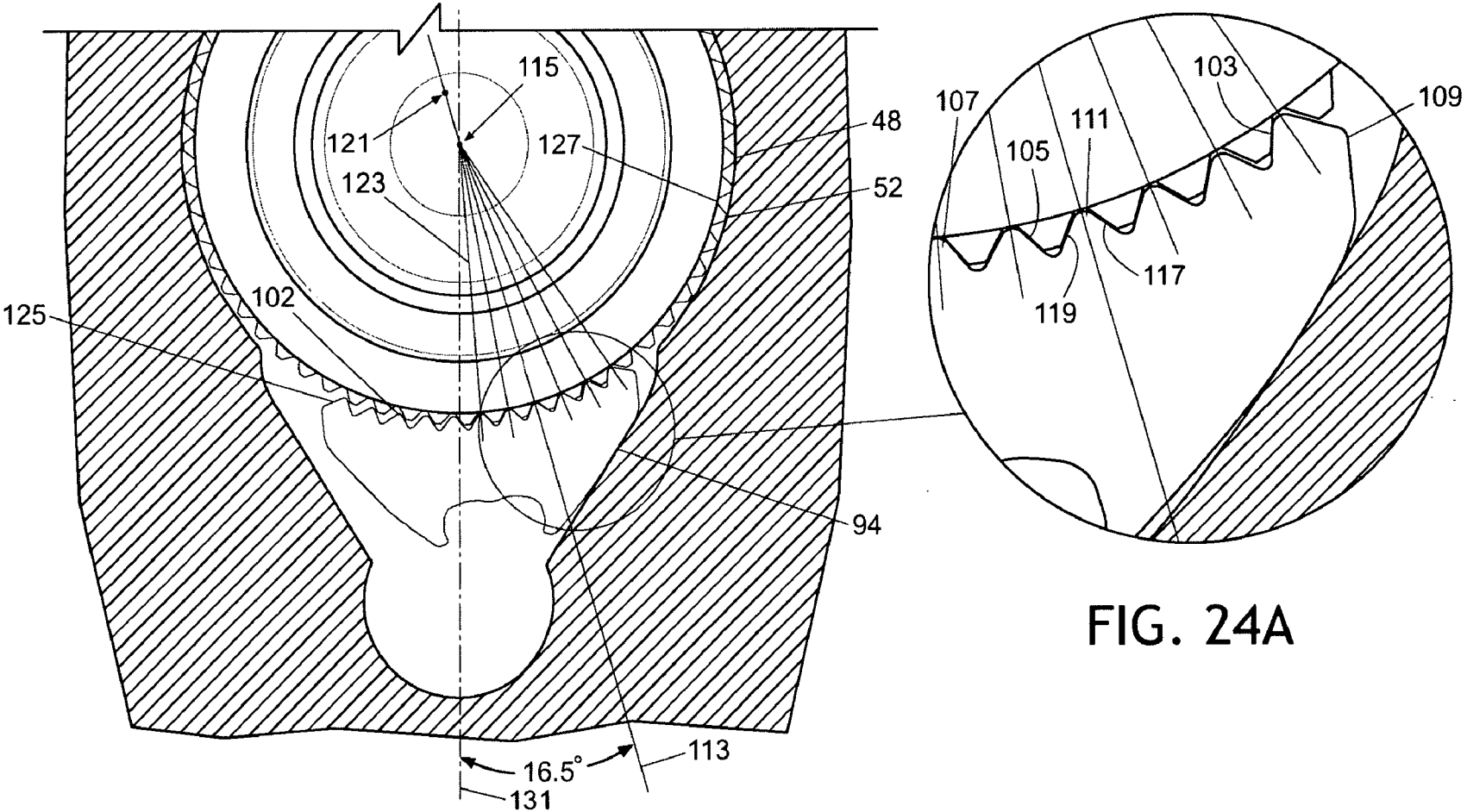
Figure 26:
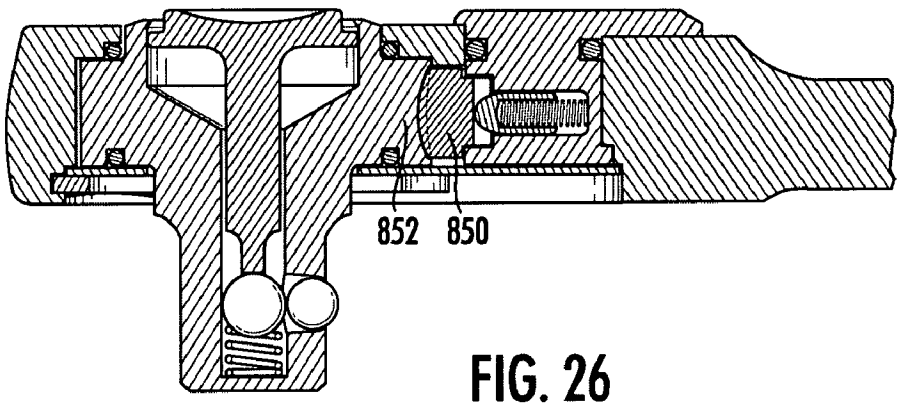
Figure 25:
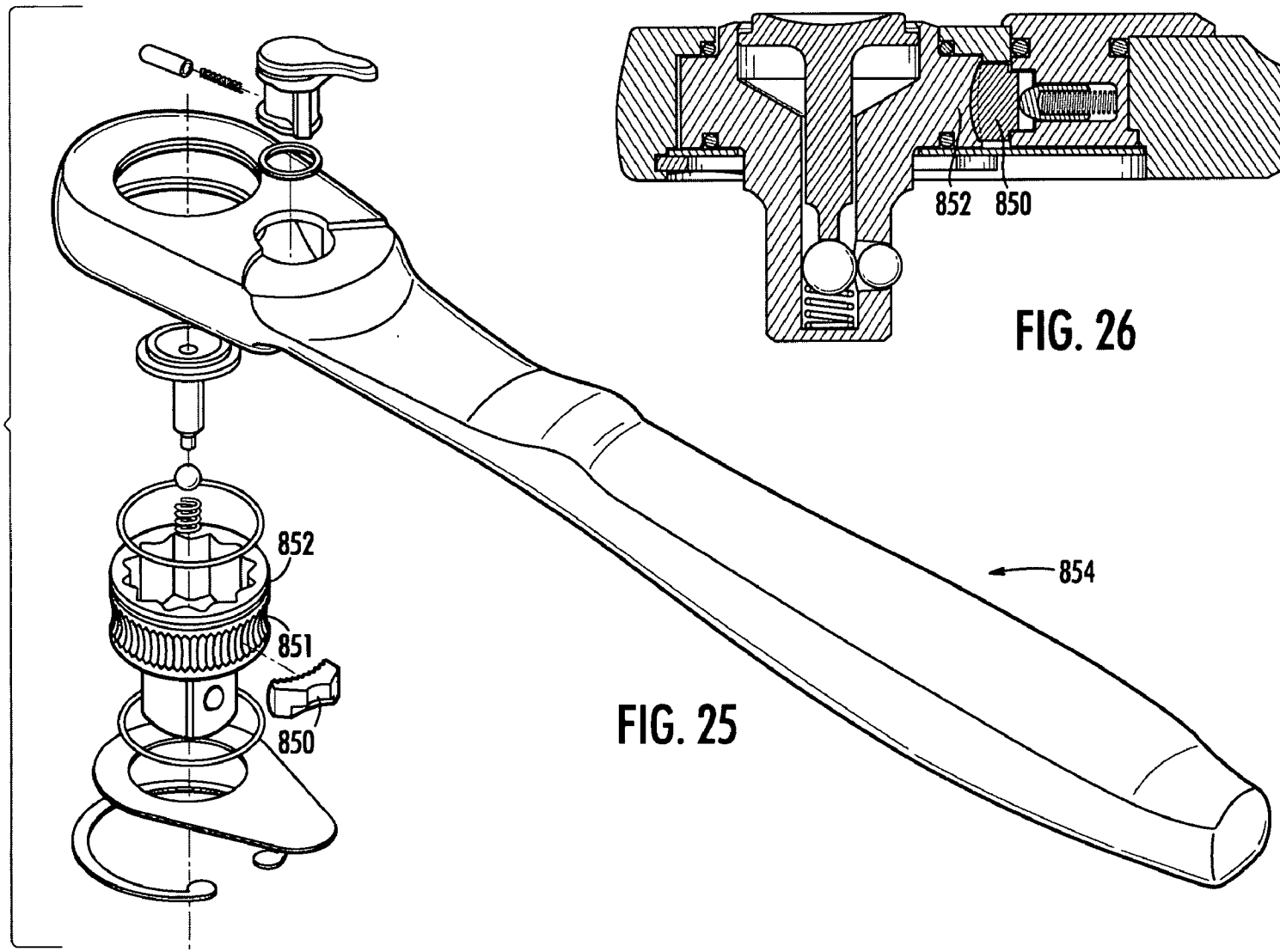
Figure 27:
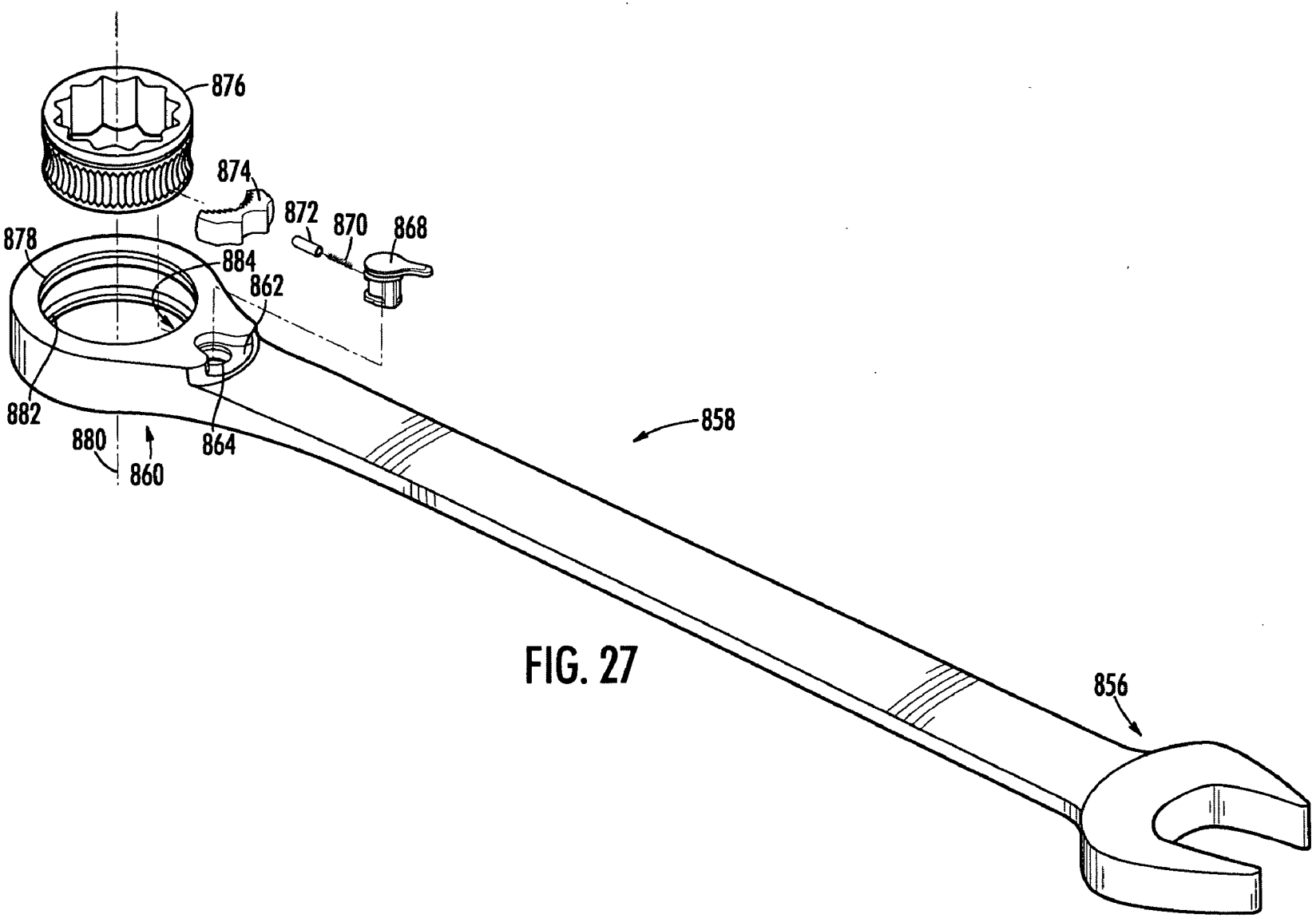
Figure 28:
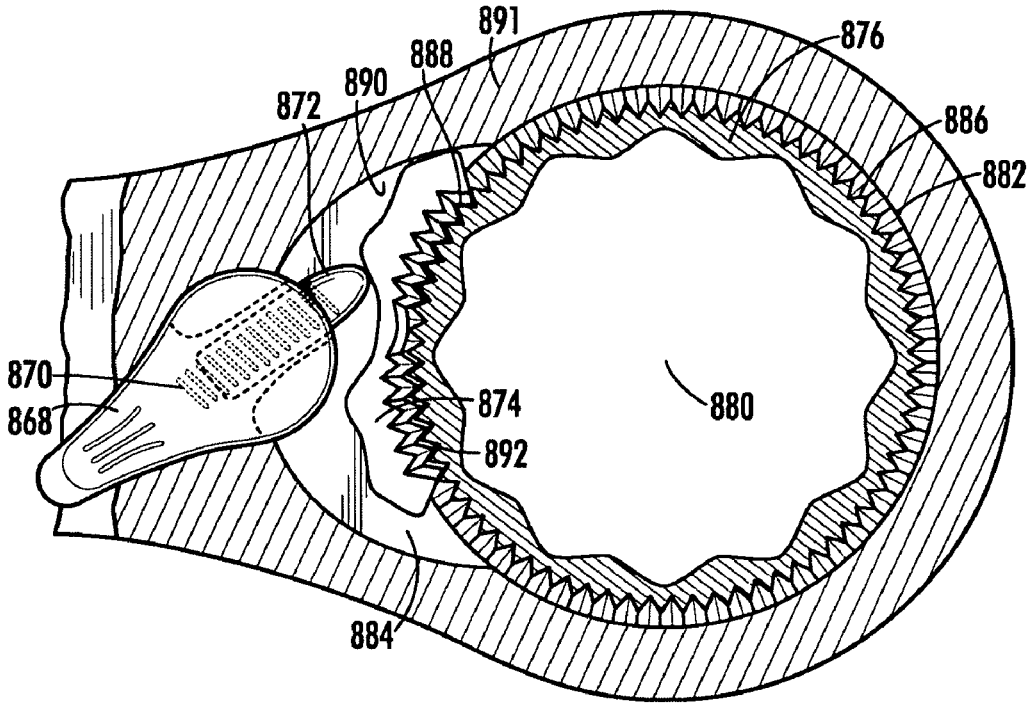
Figure 29:
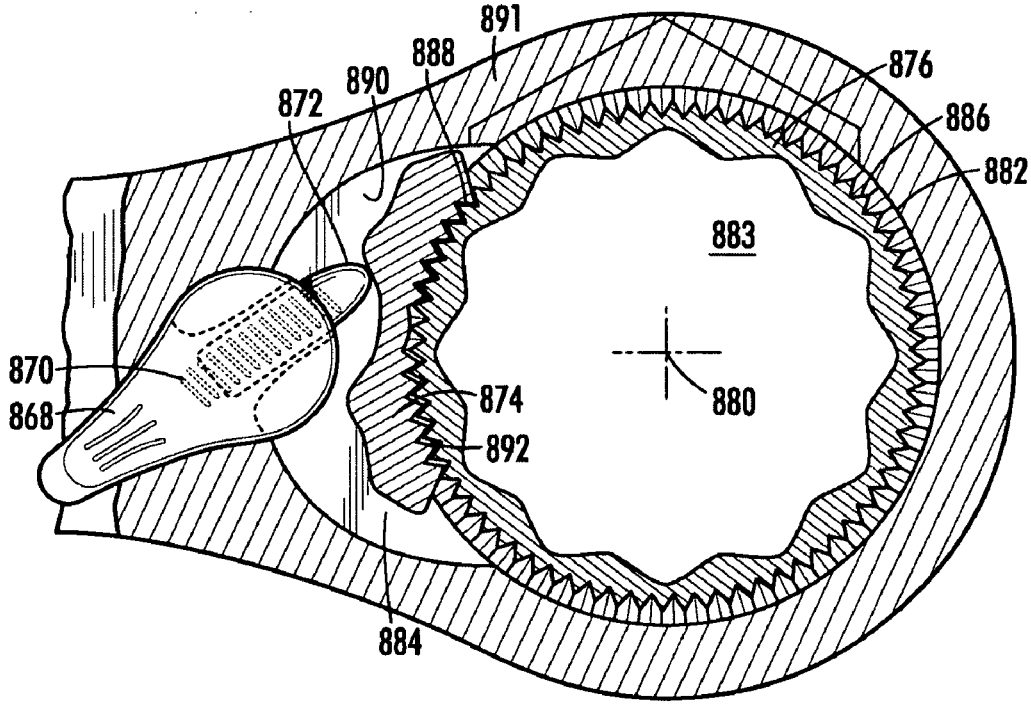
Figure 32A:
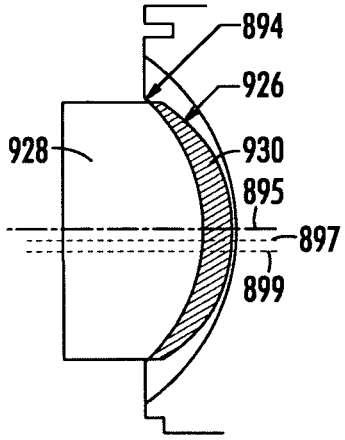
Figure 32D:
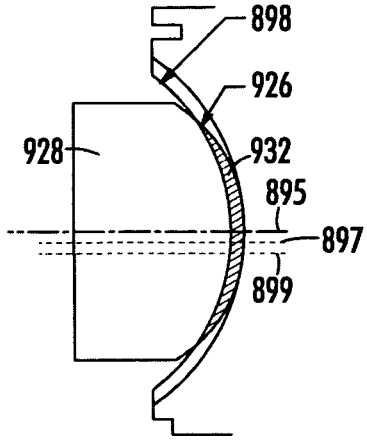
Figure 32B:
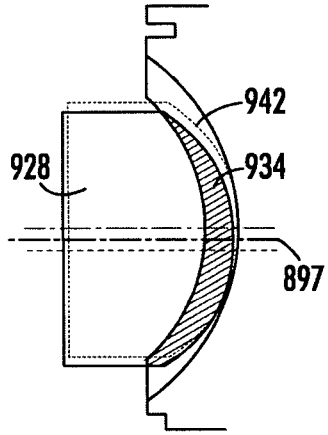
Figure 32E:
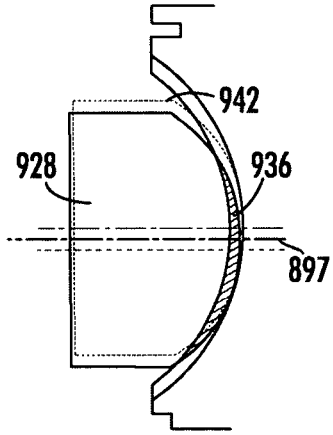
Figure 32C:
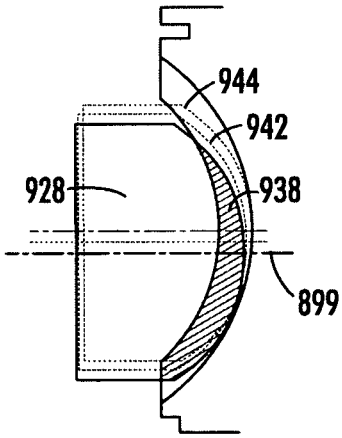
Figure 32F:
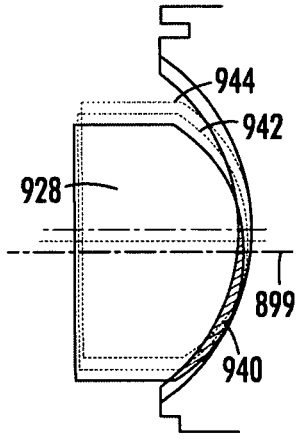
Figure 33:
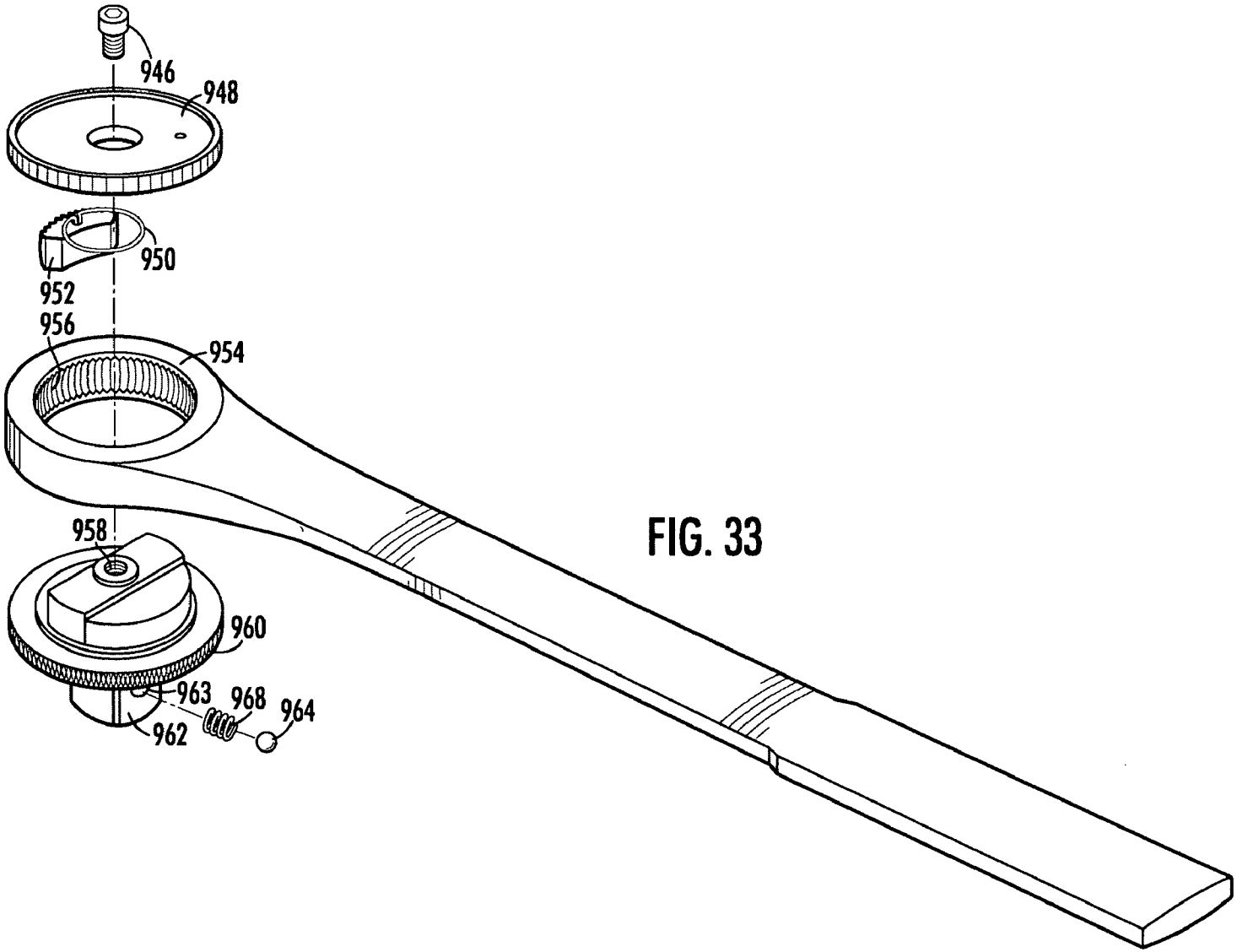

Each of FIGS. 4A, 4B, and 4C is a top view, partly in section, of the ratcheting tool as in FIG. 1;

FIG. 5A is a top view of a ratchet gear and release button of the ratcheting tool as in FIG. 1;

Each of FIGS. 5B and 5C is a side view, partly in section, of the gear and release button as in FIG. 5A;

FIG. 6 is a top view of a pawl of a ratcheting tool as in FIG. 1;

FIG. 7 is a perspective view of the pawl as in FIG. 6;

FIG. 8 is a top view of the reversing lever of the ratcheting tool shown in FIG. 1;

FIG. 8A is a partial side view, in section, of the reversing lever of FIG. 8;

FIG. 9 is a bottom view, partly in section, of the reversing lever shown in FIG. 8;

FIG. 10 is an exploded view of the reversing lever shown in FIG. 8;

FIG. 11 is a side view of a pusher as shown in FIG. 10;

FIG. 11A is a cross-sectional view of the pusher shown in FIG. 11;

FIG. 12 is a front view of the pusher shown in FIG. 11;

FIG. 13 is a perspective view of a pawl in accordance with an embodiment of the present invention;

FIG. 13A is a top view of the pawl shown in FIG. 13;

Each of FIGS. 14A, 14B, and 14C is a top view, partly in section, of a ratcheting tool in accordance with an embodiment of the present invention;

Each of FIGS. 15A, 15B, and 15C is a top view, partly in section, of a ratcheting tool in accordance with an embodiment of the present invention;

FIG. 15D is a partial cross-sectional view of the ratcheting tool shown in FIGS. 15A–15C;

FIG. 15E is a cross-sectional perspective view of a gear for use in the ratcheting tool shown in FIGS. 15A–15C;

FIG. 15F is a cross-sectional perspective view of a pawl for use in the ratcheting tool shown in FIG. 15A–15C;

FIG. 16A is a perspective view of a pawl in accordance with an embodiment of the present invention;

FIG. 16B is a rear view of the pawl shown in FIG. 16A;

FIG. 16C is a bottom view of the pawl shown in FIG. 16A;

FIG. 17 is a top view of a pawl in accordance with an embodiment of the present invention;

FIG. 18 is a partial cross-sectional view of the pawl shown in FIG. 17;

FIG. 19 is a partial cross-sectional view of the pawl shown in FIG. 17;

FIG. 20 is a top view of the pawl shown in FIG. 17;

FIG. 21 is a partial cross-sectional view of a pawl in accordance with an embodiment of the present invention;

FIG. 22 is a partial cross-sectional view of a pawl in accordance with an embodiment of the present invention;

FIG. 23 is a top view of the pawl shown in FIG. 22;

FIG. 24 is a top view of components of a ratcheting tool during a design procedure in accordance with an embodiment of the present invention;

FIG. 24A is an enlarged view of a portion of the components shown in FIG. 24;

FIG. 25 is an exploded view of a ratcheting tool having curved gear teeth and pawl teeth;

FIG. 26 is a cross-sectional view of the ratcheting tool in FIG. 25;

FIG. 27 is an exploded view of a ratcheting tool in accordance with an embodiment of the present invention;

FIG. 28 is a partially cross-sectional view of the ratcheting tool in FIG. 27;

FIG. 29 is an cross-sectional view of a ratcheting tool in accordance with an embodiment of the present invention;

FIGS. 30A through 30F are cross-sectional schematic views of a gear and a pawl with vertically curved teeth having the same radius of curvature at varying offsets;

FIGS. 31A through 31F are cross-sectional schematic views of a pawl and a gear with vertically curved teeth, where the vertical radius of curvature of the pawl teeth is less than the vertical radius of curvature of the gear teeth;

FIGS. 32A through 32F are cross-sectional schematic views of a pawl and a gear with vertically curved teeth, where the vertical radius of curvature of the pawl teeth is less than the vertical radius of curvature of the gear teeth; and FIG. 33 is an exploded view of a ratcheting tool according to an embodiment of the present invention.

Figure 34:
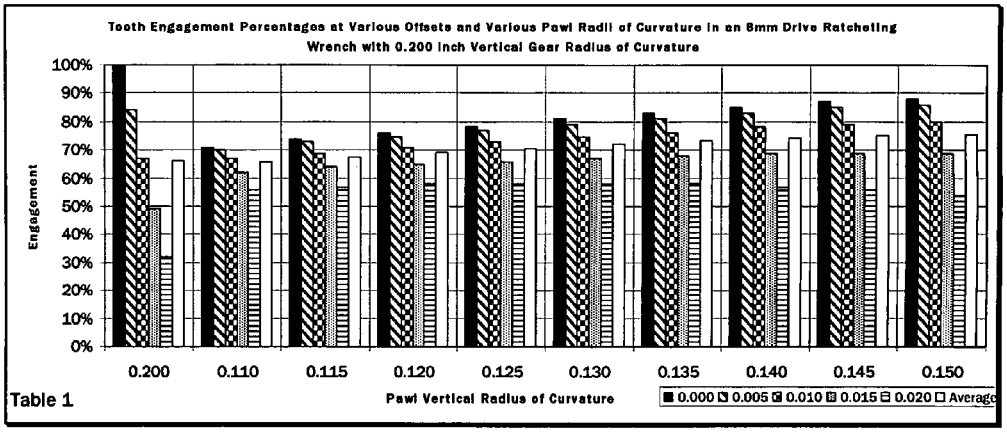
Figure 35:
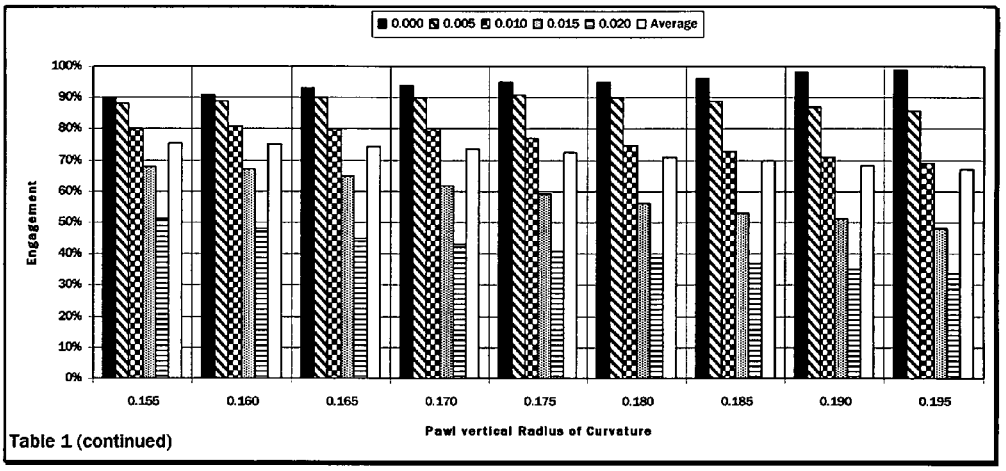
Figure 36:
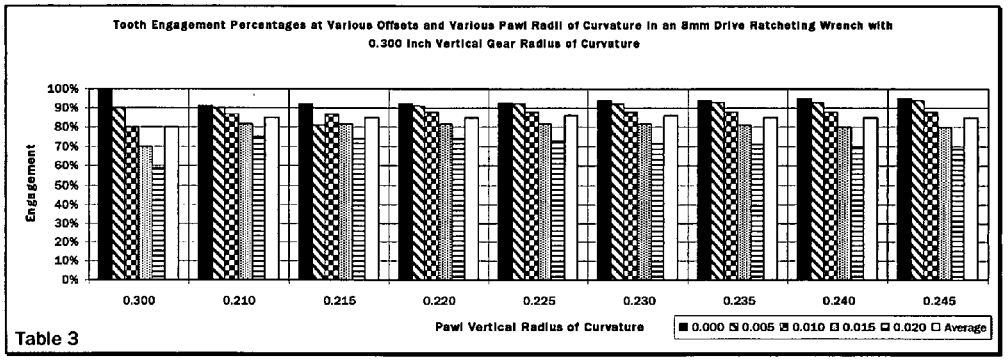
Figure 37:
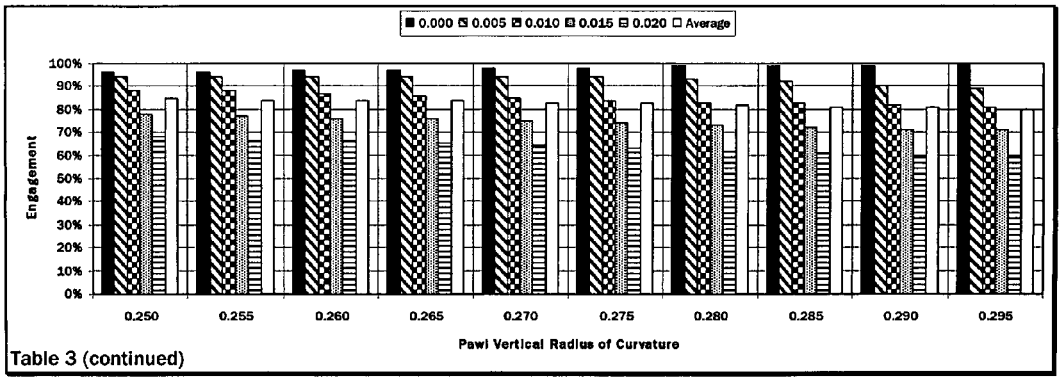
Figure 38:
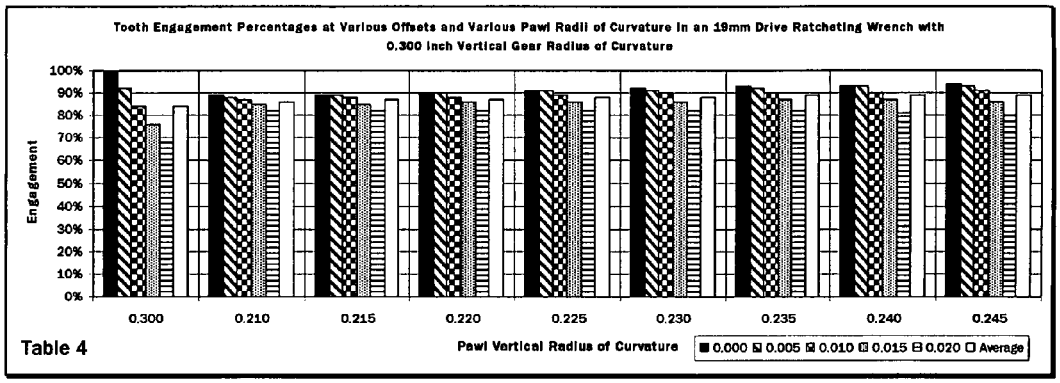
Figure 39:
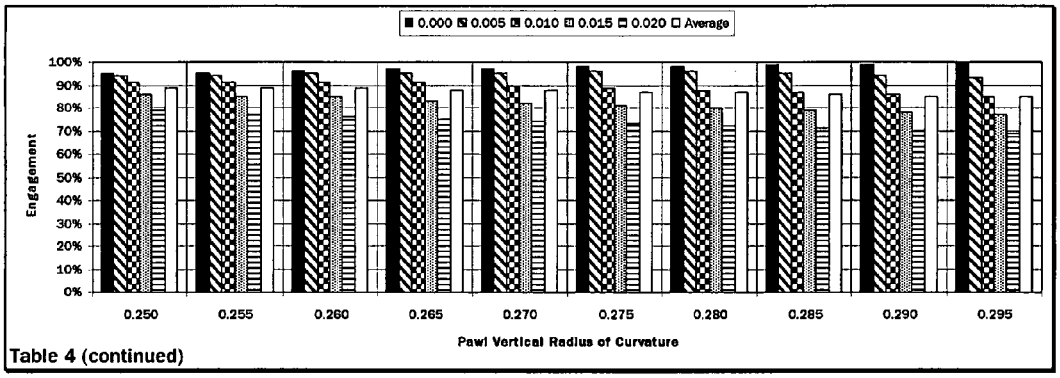

FIG. 34 is a table showing tooth engagement percentages at various offsets and various pawl radii of curvature in an 8 mm drive ratcheting wrench with 0.200 inch vertical gear radius of curvature;

FIG. 35 is a continuation of the table shown in FIG. 34;

FIG. 36 is a table showing tooth engagement percentages at various offsets and various pawl radii of curvature of an 8 mm drive ratcheting wrench with 0.300 inch vertial gear radius of curvature;

FIG. 37 is a continuatio of the table shown in FIG. 36;

FIG. 38 is a table showing tooth engagement percentages at various offsets and various pawl radii of curvature in a 19 mm ratcheting wrench with 0.300 inch vertical gear radius of curvature; and FIG. 39 is a continuation of the table shown in FIG. 38.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIG. 1, a ratcheting tool 10 includes an elongated arm, which may be formed as a handle 12 from stainless steel, metal alloys, or other suitable materials. The length of the handle 12 may vary depending on the application of ratcheting tool 10. A head 14 extends from handle 12, and the head and handle may be integrally formed from the same material.

Figure 2:
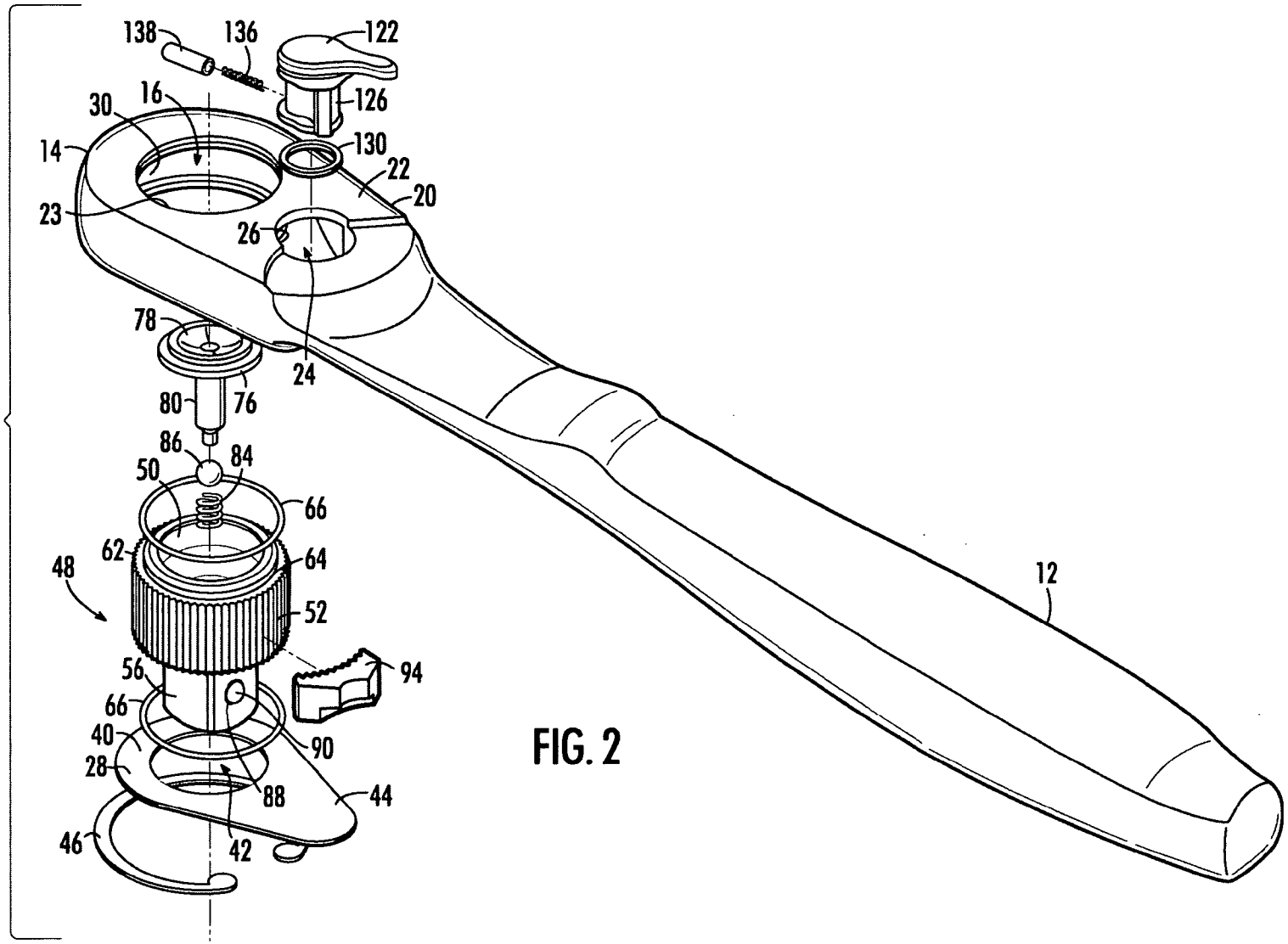
FIG. 2 is an exploded view of the ratcheting tool as in FIG. 1.
Figure 3A:
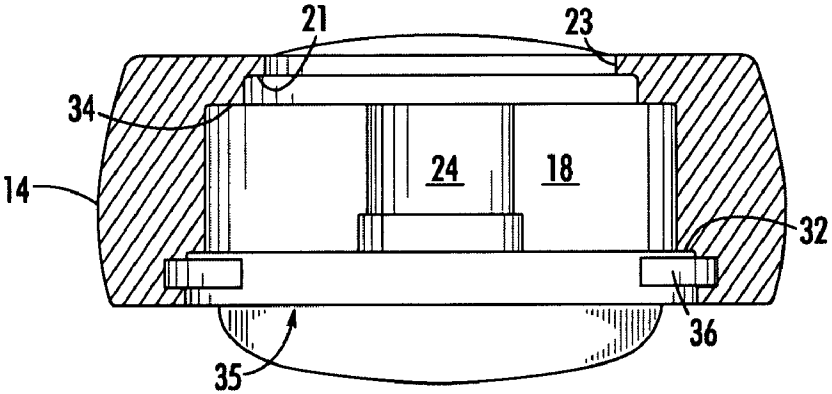
FIG. 3A is a sectional view of the body of ratcheting tool as in FIG. 1.
Figure 3B:
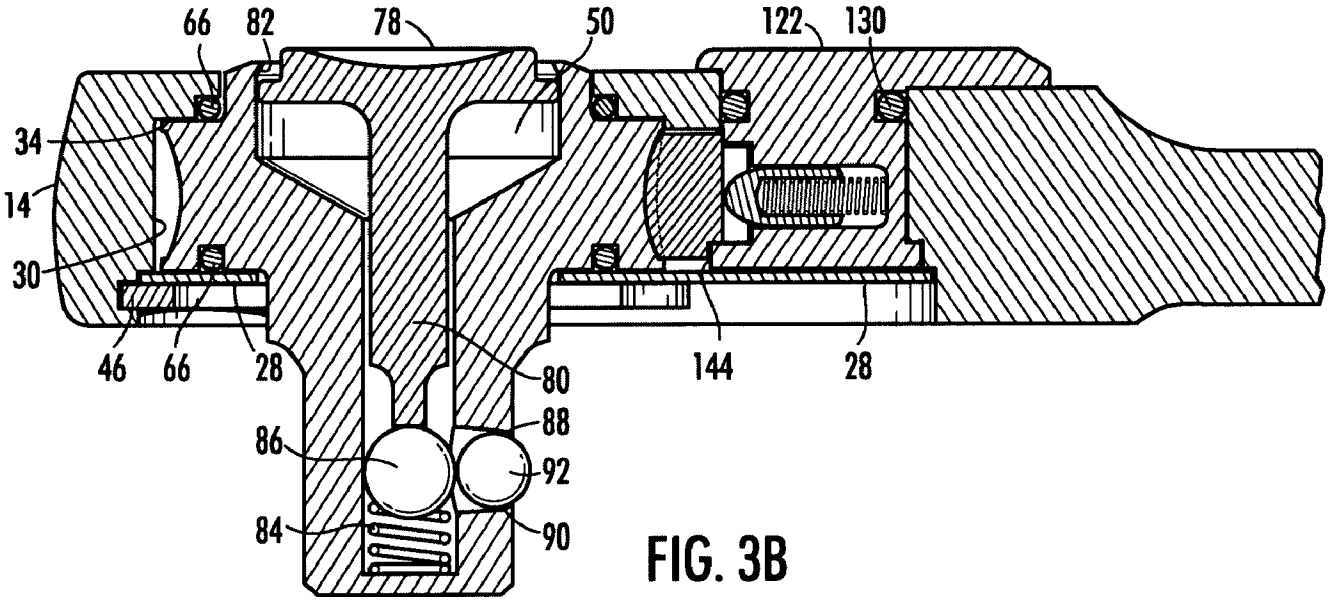
FIG. 3B is a partial sectional view of the ratcheting tool as in FIG. 1.

Referring to FIGS. 2, 3A, and 3B, head 14 defines a relatively large and generally cylindrical through-hole compartment 16. A web portion 20 is intermediate to head 14 and handle 12 and defines a smaller, wedge-shaped compartment 18 (see also FIGS. 4A–4C). A generally cylindrical compartment 24 extends through a top face 22 into web 20 at a hole 26 and overlaps compartment 18. Compartment 18 is closed above by top face 22 and opens into both compartments 16 and 24. The underside of head 14 is open and receives a cover 28 that secures certain components of ratcheting tool 10 within compartments 16, 18 and 24, as described in greater detail below.

A wall 30 defines compartment 16 between a radially outward extending ledge 32 at one end and a radially inward extending ledge 34 at its other end. An annular groove 36 is defined in a vertical wall extending down from ledge 32 and surrounding most of compartment 16.

Cover 28 has an annular portion 40 defining a hole 42 and a tab portion 44 extending from annular portion 40. An opening 35 in the bottom of head 14 and web 20 receives cover 28 so that annular portion 40 sits on ledge 32. Annular groove 36 receives a C-clip 46 to secure cover 28 between the C-clip and ledge 32 so that cover 28 is held in position over compartments 16, 18, and 24.

Compartment 16 receives an annular gear ring 48 having an inner surface 50 that is concentric with wall 30 of head 14. As shown also in FIGS. 5A to 5C, the outer circumference of gear ring 48 defines a series of vertically-aligned teeth 52. The gear ring's bottom side defines an extension portion 56 surrounded by a flat annular shoulder 58 that defines an annular groove 60. On the top side, a top ledge 62 surrounds an upwardly extending wall 64. Gear ring 48 fits into compartment 16 so that wall 64 extends through a hole 23 in top face 22 and so that ledge 62 abuts ledge 34. When cover 28 is secured to head 14, extension portion 56 extends through hole 42. Circular portion 40 abuts shoulder 58, thereby retaining gear ring 48 in compartment 16.

Extension portion 56 and wall 64 fit through hole 42 and hole 23, respectively, with sufficient clearance so that the gear ring is secured in the radial direction yet is permitted to rotate with respect to head 14. A lower O-ring 66 is received in annular groove 60 and abuts cover 28, while an upper O-ring extends around wall 64 between ledges 21 and 62. The O-rings aid in smooth rotation of gear ring 48 and minimize the amount of dirt and debris that can enter compartment 16. O-rings 66 may be formed from pliable rubbers, silicones, metals, or other suitable material.

Extension portion 56 is square shaped in cross-section and is adapted to receive a standard three-eighths (⅜) inch socket, which should be well understood in the art. Extension 56 may also be sized to fit one-quarter (¼) inch, one-half (½) inch, or other size sockets as desired.

Inner surface 50 of gear ring 48 surrounds a blind bore 68 centered around the axis of gear ring 48. Bore 68 receives a push button 76 having an annular top 78 and a cylindrical shaft 80. The top end of bore 68 defines a shoulder 82 that is peened inward to retain button 76 in the bore. A spring 84 and ball 86 in the bottom of bore 68 bias button 76 upward against shoulder 82. A cylindrical bore 90 intersects bore 68 at a right angle and receives a ball 92. An edge 88 is peened inward to retain the ball in the bore.

Ball 86 controls the position of ball 92 within bore 90. Normally, when spring 84 and ball 86 push the top of button 76 up against shoulder 82, ball 86 is aligned with ball 92, thereby pushing ball 92 out against edge 88 of bore 90. In this position, a portion of ball 92 extends out of bore 90 to retain a socket on extension 56. To remove the socket, the operator pushes push button 76 down against spring 84. This moves ball 86 below bore 90 and aligns a narrowed end of shaft 80 with ball 92, thereby allowing ball 92 to move back into bore 90 and release the socket.

Referring to FIGS. 4A–4C, compartment 18 receives a generally wedge-shaped pawl 94 between side walls 98 and 100. Cover 28 and top face 22 (FIG. 2) of web 20 retain pawl 94 from below and above. Walls 98 and 100 are formed so that vertical planes (i.e. planes perpendicular to the page) defined by the walls intersect a vertical plane 99 that passes through the center of compartments 16 and 24 (see FIGS. 2 and 3A) at an angle such that compartment 18 optimizes the load-bearing and ratcheting capabilities of ratcheting tool 10. The size of the angle may vary depending on the tool's intended use. A larger angle, for example, allows for greater load-carrying characteristics between gear ring 48 and pawl 94, while a smaller angle provides for better ratcheting and reversing. Thus, the angle chosen in a given instance preferably provides the best combination of gear/pawl tooth loading and clearance for the pawl during ratcheting and reversing. In a preferred embodiment, the angle between plane 99 and each of side walls 98 and 100 is 31 degrees and is preferably within a range of about 27 degrees to about 35 degrees.

As shown in FIGS. 6 and 7, pawl 94 defines a plurality of vertically-aligned teeth 102 across the pawl's front face in an arc having a radius R1. In the illustrated embodiment, the tips of the teeth are rounded slightly, and R1 is measured to the rounded tips of the teeth. The radius R1 is different than a radius R2 (FIG. 5A) between the center 68 of gear ring 48 and the troughs of its teeth 52. Because of manufacturing tolerances, the tips of the pawl teeth and the troughs of the gear teeth vary slightly in the radial direction, as should be understood in this art. Thus, radii R1 and R2 should be understood to lie within the pawl and gear tolerance ranges and are assumed to extend to the mid-points of the respective tolerance range for purposes of this discussion. Furthermore, it should be understood that radii R1 and R2 may be taken at other locations on the gear and the pawl, for example at the tips of the gear teeth and the troughs of the pawl teeth.

The back face of pawl 94 defines a pocket 104 having two curved portions 108 and 110 separated by a bridge 112 and having symmetric rearwardly-extending sides 114 and 116. A notch 118 extends into the back end of pawl 94 from a bottom surface 120.

Referring to FIGS. 8, 8A, 9, and 10, a reversing lever 122 includes a handle portion 124 and a bottom portion 126. The outer surface of bottom 126 defines an annular groove 128 that receives an O-ring 130, which extends slightly outward of groove 128. Groove 128 is located proximate handle portion 124 such that an annular shelf 132 extends between groove 128 and the front of handle 124. Bottom 126 defines a blind bore 134 that receives a spring 136 and pusher 138. Referring to FIGS. 11, 11A, and 12, pusher 138 is cylindrical in shape and defines a blind bore 140 in its rear end and a rounded front end 142. Bore 140 is adapted to receive spring 136 so that the spring biases pusher 138 radially outward from bore 134.

Referring to FIGS. 2, 3B, 8A, and 10, hole 26 in web 20 receives the lever's bottom portion 126. The diameter of bottom portion 126 is approximately equal to the diameter of hole 26, although sufficient clearance is provided so that the reversing lever rotates easily in the hole. Upon insertion of bottom portion 126 into hole 26, the hole's side pushes O-ring 130 radially inward into groove 128 so that the O-ring thereafter inhibits the entrance of dirt into the compartment. Referring also to FIG. 6, pusher 138 extends into pocket 104 and engages curved portions 108 and 110 and sides 114 and 116, depending on the position of the pawl and lever. A radially outward extending lip 144 at the bottom of the lever fits into notch 118 in the pawl, and a lip 145 extends into a groove at the bottom of compartment 24, thereby axially retaining lever 122 in its compartment.

In operation, as shown in FIGS. 4A to 4C, pawl 94 may slide to either side of compartment 18 laterally with respect to the gear between two positions in which the pawl is wedged between the body and the gear. In FIG. 4C, lever 122 is rotated to its most clockwise position, and pawl 94 is wedged between gear ring 48 and top side 98 of compartment 18. Spring 136 pushes the pusher forward so that the pusher's front end 142 engages pocket side 114 and thereby biases the pawl to the wedged position. If torque is applied to handle 12 (FIG. 2) in the clockwise direction when a socket on the gear extension engages a work piece, the top side of compartment 18 pushes pawl teeth 102 on the top portion (from the perspective of FIG. 4C) of the pawl against opposing gear teeth 52. That is, the pawl remains wedged between the gear ring and the compartment's top edge, and the force applied from the operator's hand to the pawl through top side 98 is therefore applied in the clockwise direction to the work piece through gear ring 48.

If an operator applies torque to the handle in the counterclockwise direction, gear teeth 52 apply a counterclockwise reaction force to pawl 94. If gear ring 48 remains rotationally fixed to a work piece through a socket, teeth 52 hold the pawl so that the pawl pivots slightly about the third tooth in from the top end of the pawl (as viewed in FIG. 4C) and moves back and down into compartment 18. This causes pawl pocket side 114 to push back against pusher tip 142 and the force of spring 136 until pawl teeth 102 ride over the gear teeth. Spring 136 then moves the pusher forward against side 114, forcing pawl 94 back up toward the top face of compartment 18 and into the next set of gear ring teeth. This ratcheting process repeats as the operator continues to rotate handle 12 counterclockwise.

To change the operative direction of ratcheting tool 10, the operator rotates switch 122 in the counterclockwise direction (as viewed in FIG. 4B). Lever bottom portion 126 (FIG. 2) rotates in hole 26, and the pusher moves counterclockwise in the pawl pocket through curved portion 108 toward bridge 112 (FIG. 6). Initially, the pawl pivots slightly, and the load-bearing pawl teeth move away from the gear teeth. As the pusher moves toward the bridge, the pawl begins to shift down and back in compartment 18. Further rotation brings the pusher into contact with the bridge, causing the pawl teeth to ride down and back into compartment 18 over the gear teeth. Gear ring 48 may also rotate slightly. In this position, pawl 94 moves the pusher back against the force of spring 136. As the operator continues to rotate switch 122, the pusher moves into curved portion 110 and pushes forward against wall 116. This applies a counterclockwise force to the pawl so that the pawl moves downward in compartment 18 and wedges between the gear ring and the compartment's bottom edge 100. When the pawl has moved over to this wedged position, the configuration and operation of the gear, the pawl, and the lever mirror the pawl's operation described above with respect to FIG. 4C. That is, the tool ratchets and applies torque to a work piece in the same manner but in the opposite direction.

FIGS. 17 to 20 provide dimension details for a pawl 94 sized for a three-eighths (3/8) inch ratcheting wrench. As should be understood in this art, the ratchet's "size" refers to the size of internal squares of sockets it accepts. Generally, the actual size of the ratcheting tool, including its gear and pawl, varies with the tool's rated size. The dimension examples below are provided solely to illustrate one exemplary variation among such tool sizes but are not intended to limit the present invention to those dimensions. Moreover, a description is provided below of a method according to an embodiment of the present invention by which certain dimensions of the pawl may be determined for a tool and gear of a given variable size. Thus, it should be understood that various arrangements of the present invention may be suitable in various circumstances.

It should also be understood, for example, that the construction of other components may vary. For example, the reversing lever may be formed as a ring concentric with the gear and having an extension that fits into the pawl so that rotation of the ring moves the pawl laterally across the compartment.

As indicated previously, the radius R1 of a curve defined by the tips of the pawl teeth is larger than the radius R2 (FIG. 5A) of a curve defined by the troughs of the gear teeth. The ratio of R1 to R2 is preferably within a range of 1:1.08 to 1:1.3. In the example shown in FIGS. 18–21, the ratio is 1.0 to 1.12, where radius R1 equals 0.458 inches. The depth of the gear teeth and the pawl teeth is approximately 0.020 inches.

Preferably, the gear teeth are formed uniformly about the gear's circumference. The depth of each tooth, which may be defined as the distance along a radius of the gear extending between the tooth's tip and an arc connecting the troughs beside the teeth, is the same. The internal angle between the sides of a tooth (the "included" angle) is the same for each tooth, and the angle between sides of adjacent teeth (the "adjacent" angle) is the same for each pair of adjacent teeth.

The dimensions of the pawl teeth, and the ratio between gear radius R2 (FIG. 5A) and pawl radius R1 (FIG. 19), may be determined by modifying an initial assumption that the pawl teeth will exactly fit the gear teeth. That is, the depths, included angles and adjacent angles of the pawl teeth initially match the corresponding dimensions of the gear teeth. Both sides of each pawl tooth are then pivoted (for example, using a computer-aided design ("CAD") system) toward each other by 1.5 degrees about the tooth's theoretical tip, thereby reducing the tooth's included angle by approximately 3 degrees. The non-loaded side 105 of each of the three outermost teeth on each side of the pawl is then shaved by 0.003–0.005 inches, and the tips of the teeth are rounded. The degree of rounding increases from the outermost teeth to the pawl center so that the rounded tips define a common radius (within manufacturing tolerances). As will be appreciated, this procedure results in a slightly non-flush engagement between the load-bearing sides 103 of the pawl teeth and the opposing gear tooth sides.

Because the pawl radius R1 (FIG. 19) is larger than the gear radius R2 (FIG. 5A), the included angles and adjacent angles of the pawl teeth are not uniform, as can be seen in FIG. 18. The variation results from pivoting the pawl teeth's non-load-bearing sides 105 so that the included angle of each tooth is reduced by a desired amount (preferably one to two degrees) less than the included angle of the gear teeth. This adjustment results in a slight gap between the non-load-bearing gear teeth sides and the non-load-bearing pawl teeth sides 105. The gap reduces or eliminates fluid adhesion (caused by grease or oil in the mechanism) and taper fit between the gear and pawl teeth, thereby facilitating smooth removal of the pawl teeth from the gear teeth during ratcheting and pawl reversal.

FIG. 18 illustrates the dimensions of pawl teeth to one side of a center tooth 107. The dimensions and positions of the teeth on the opposite side of tooth 107 are a mirror image of the illustrated side and are therefore not shown.

FIG. 21 illustrates a pawl used in a wrench sized for one-half (½) inch sockets. The pawl radius R1 (FIG. 17) is scaled by the ratio of the gear diameter for the one-half inch ratchet (e.g. approximately 1.155 inches) to the gear diameter for the three-eighths inch ratchet (e.g. approximately 0.866 inches), to obtain a pawl radius R1 (FIG. 21) of approximately 0.611 inches. The ratio of the pawl radius to the gear radius is again 1:1.12, and the depth of the gear and pawl teeth is approximately 0.028 inches.

It should be understood that the ratio of the gear diameters is used to scale the dimensions of the pawl, reversing lever, ratchet head, and other ratchet components. The gear diameter for determining the ratio is measured from tip to tip of teeth on opposite sides across (i.e., opposite by 180 degrees across) the gear. When determining the ratio of the pawl radius to the gear radius, R1 is measured to the tips of the pawl teeth (FIG. 17), and R2 is measured to the troughs of the gear teeth (FIG. 5A).

FIGS. 22 and 23 illustrate a pawl used in a ratchet sized for one-quarter (¼) inch sockets. The depth of the gear and ratchet teeth is approximately 0.012 inches. As with the one-half inch size, it is possible to define the pawl radius for the quarter-inch ratchet by scaling the three-eighths inch pawl radius by the ratio of the gear sizes. Where, however, such direct reduction in scale brings the gear teeth and pawl teeth to dimensions at which manufacturing tolerances could lead to interference between the engaged teeth, the pawl design steps are preferably re-executed. Thus, the pawl dimensions may be determined through the same steps as described above for the three-eighths inch design, except that (1) the non-loaded sides of all pawl teeth are shaved and this time by approximately 0.001–0.002 inches, and (2) the two center pawl teeth are removed. The resulting pawl radius R1 in FIG. 23 is approximately 0.347 inches—slightly smaller than what it would be if the radius were directly scaled from the three-eighths inch ratchet according to the ratio of the gears (e.g. 0.773). Similarly, the ratio of the pawl radius to the gear radius is approximately 1:1.09—again, slightly different from the three-eighths and one-half inch ratchets.

FIGS. 17–23 illustrate that the gear/pawl radius ratio may vary among tools of different sizes, but the ratio may also vary among tools of the same size. That is, the particular ratio for a given tool may be selected independently of other tool designs, preferably within a range of about 1:1.08 to about 1:1.3. A ratio for a particular tool design may be determined by trial and error, but it is believed that the two primary factors determining an appropriate range for the radius ratio are (1) the gear radius and (2) the depth of the teeth on the gear and the pawl. Once these parameters are chosen, a radius ratio may be selected on a CAD system or other graphic means through an alternate method described with respect to FIG. 24.

FIG. 24 represents a CAD depiction of a gear 48 and a pawl 94. The operation of CAD systems should be well understood in this art and is therefore not discussed herein. Initially, the pawl and gear are disposed so that they face one another. The body of the ratchet wrench head is illustrated for purposes of context but is preferably omitted from the CAD drawing. The theoretical (i.e. non-rounded) tip of each pawl tooth lies on a respective line 123 that passes through the center 115 of gear 48 and the trough between the opposing gear teeth on the loaded side of the pawl. The included angles (FIG. 18) are consistent across all pawl teeth and are the same as the gear teeth adjacent angles. The depth of the pawl teeth is the same as the depth of the gear teeth, and all teeth are as yet not rounded. An initial gear/pawl radius ratio is selected arbitrarily. The adjacent angle (FIG. 18) depends on the selected initial radius ratio but is the same for all pawl teeth. If a 1:1 ratio is selected, the pawl's adjacent tooth angle is the same as the included angle of the gear teeth and vice versa.

Next, a pivot tooth is selected on one side of the pawl's center tooth. Preferably, the pivot tooth is the principal load-bearing tooth. The particular number of load-bearing teeth on either pawl side depends on the density of teeth on the pawl, the design of the back of the pawl and the design of the compartment wall against which the pawl sits. Given a design where these factors are known, the load-bearing teeth may be identified by applying very high loads to a ratchet and observing which teeth are first to shear or by simply assessing the design from experience with prior designs. In the embodiment shown in FIG. 24, the load-bearing teeth are the four outermost teeth inward of pawl end 109, and the pivot tooth is preferably tooth 111—the closest one of these teeth to center tooth 107 (FIG. 18).

After selecting the pivot tooth, the pawl is moved so that pivot tooth 111 is received in exact alignment with the gap between adjacent teeth 117 and 119 on the gear. That is, tooth 111 is fully received in the gap between teeth 117 and 119, and its sides 103 and 105 are flush against the opposing sides of teeth 117 and 119, respectively. If the initial radius ratio is not 1:1, the pivot tooth is the only tooth that fits exactly between its opposing gear teeth. The teeth on either side of the pivot tooth are increasingly misaligned with the gaps between their opposing gear teeth.

The final pawl radius is defined along a radius line 113 that includes center 115 of gear 48 and the non-rounded tip of the pivot tooth. A point 121 on line 113 is initially defined as the center of curvature of the non-rounded tips of the pawl teeth as originally drawn on the CAD system. That is, point 121 is the origin of the pawl radius, and the pivot tooth defines the point at which an arc defined by the gear radius is tangent to an arc defined by the pawl radius. To determine the final pawl radius R1 (in this instance, the radius to the theoretical tips of the pawl teeth), point 121 is moved along line 113 behind point 115. The adjacent angles between the pawl teeth change in accordance with the changing pawl radius. The pawl teeth depth and included angles, as well as the alignment of the pivot tooth in the gap between its opposing gear teeth, remain fixed. As point 121 moves closer to gear center point 115 along line 113, the pawl radius decreases, and the pawl teeth on either side of the pivot tooth move closer into the gaps between the opposing gear teeth. Conversely, the pawl radius increases as point 121 moves away from center point 115, and the pawl teeth on either side of the pivot tooth move away from the gear teeth. Preferably, point 121 is selected so that the non-rounded tip of the outermost tooth 125 on the opposite side of center tooth 107 from the pivot tooth is within one-half to fully out of the gap between its opposing gear teeth. That is, assume that an arc defined by troughs 127 between the gear teeth is assigned a value of zero and that an arc defined by the gear tooth tips is assigned a value of 1. The tip of pawl tooth 125 preferably is disposed within a range including and between two intermediate arcs located at 0.50 and 1.0.

In an alternate embodiment, the pivot tooth is determined through selection of radius line 113, rather than the other way around. Once the pawl has been located by the CAD system at one of the two wedged positions in engagement with the gear, line 113 is drawn (in one preferred embodiment) at 16.5 degrees with respect to center line 131 so that line 113 passes through the loaded side of the pawl. The tooth through which the line passes is chosen as the pivot tooth, and line 113 is rotated about point 115 so that it passes through the tip of the selected tooth. If line 113 passes exactly between two pawl teeth, either tooth may be selected, but the outer tooth is preferred. Following selection of the pivot tooth and adjustment of line 113, the pawl radius is determined in the same manner as discussed above.

Once the pawl radius, and therefore the gear/pawl radius ratio, have been determined, the pawl teeth are modified to their operative dimensions. The pawl remains located by the CAD system in the wedged position against the gear as shown in FIG. 24, and the pivot tooth remains in exact alignment with its opposing gear teeth. The non-loaded side 105 of each tooth, including the pivot tooth, is pivoted about the tip of the tooth so that the tooth's included angle is preferably one to two degrees less than the adjacent angle of the gear teeth. The side of the center tooth facing the loaded pawl teeth is adjusted in this step as a non-loaded side. The load-bearing sides 103 are not adjusted. Thus, except for the pivot tooth, the load-bearing sides of the pawl teeth are slightly out of flush with their opposing gear tooth sides.

This defines the dimensions of the teeth on one side of the pawl. The teeth on the other pawl side are then adjusted to be the mirror image (across the pawl's center line) of the first side. The pawl (and gear) teeth are rounded as desired. As indicated in FIG. 19, the rounded tips preferably remain on a common arc.

At this point, the pawl tooth design is complete, and a pawl with the selected dimensions may be operated in a tool as shown in FIGS. 4A–4C. In particular, the selection of the pawl radius so that the tip of the outermost non-loaded tooth is one-half to fully out of the gear teeth generally assures that when one side of the pawl or the other is wedged in the pawl compartment in engagement with the gear, only the teeth on that side are loaded against the gear teeth. The teeth on the trailing side remain unloaded.

Although the discussion above describes a gear/pawl arrangement in a socket wrench, it should be understood that the present invention may encompass other ratcheting tools, for example a ratcheting box end wrench as shown in FIGS. 15A to 15F. Generally, ratcheting box end wrench 310 operates under the same principles as ratcheting tool 10 (FIG. 1). Box end wrench 310 includes a handle 312 and a head 314 extending from the handle, which may be formed from a suitable material such as stainless steel or a metal alloy. Handle 312 may be a solid piece and has a generally rectangular transverse cross-section, although the length and cross-sectional shape of handle 312 may vary as desired.

Head 314 includes a wall 328 that defines a generally cylindrical through-hole compartment 316. A smaller, semi-circular compartment 318 is defined in a web portion 320 intermediate head 314 and handle 312. A generally cylindrical compartment 324 extends through face 322 into web 320 and overlaps compartment 318. Compartment 318 is closed above and below by top and bottom surfaces of web 320, and compartment 318 opens into both compartments 316 and 324. A groove 330 about compartment 316 extends into head 314 from wall 328 proximate the top edge of the wall for receipt of a C-clip as discussed below. An annular ledge 334 extends radially inward into compartment 316 from wall 328 proximate the wall's bottom edge.

Compartment 318 differs from the pawl compartment described above in ratcheting tool 10 (FIG. 2) in that both the top and bottom faces of head 14 are closed over the compartment. Compartment 318 may be formed by a key-way cutter or a computer numeric controlled (CNC) milling machine that cuts compartment 318 with a cutting tool inserted into compartment 316. The cutting tool has a shaft with a disk-shaped cutter at the end of the shaft, and cutting edges are formed about the disk's circumference. The disk's radius is greater than the depth of compartment 318 between compartments 316 and 324, and the disk's height is less than the thickness of web 20. The tool is initially inserted into compartment 316 so that the tool's axis passing through the center of the disk and the shaft is parallel to the axis of cylindrical compartment 316. That is, the cutting disk is generally coplanar with the compartment.

Compartment 316 receives a gear ring 336. The gear ring has an inner surface 338 that is concentric with wall 328 and that defines a plurality of aligned flats 350 spaced equiangularly about inner surface 338 to engage the sides of a bolt, nut or other work piece. The outer circumference of gear ring 336 defines a series of vertically-aligned teeth 340. A bottom side of gear ring 336 defines an extension portion 342 surrounded by a flat annular shoulder 344. Extension portion 342 fits through ledge 334 so that shoulder 344 sits on the ledge and retains gear ring 336 in the lower axial direction. Extension portion 342 fits through ledge 334 with sufficient clearance so that the ledge secures the gear ring in the radial direction yet permits the gear ring to rotate with respect to head 314.

Gear ring 336 defines an annular groove 346 about its outer surface proximate its upper end. A C-ring 348 extending from groove 346 is compressed inward into the groove as the gear ring is inserted into the head. When grooves 300 and 346 align, the C-ring snaps into groove 330, thereby securing gear ring 336 in the upper axial direction.

A pawl 394 is received in compartment 318 so that the top and bottom surfaces of compartment 318 retain the pawl from above and below. Pawl 394 may be designed as described above with respect to FIG. 24, although the given dimensions may differ. In a preferred embodiment, for example, line 113 is disposed at 25 degrees with respect to center line 131.

A reversing lever 372 includes a handle portion 374 and a bottom portion 376 extending below the handle portion. Bottom 376 defines a blind bore 391 that receives a spring 386 and a generally cylindrical pusher. The pusher defines a blind bore 390 in its rear end and a rounded tip at its front end. Bore 390 receives spring 386, and the spring biases pusher 388 radially outward from bore 391.

Hole 326 in web 320 receives lever bottom portion 376. The outer diameter of bottom portion 376 is approximately equal to the inner diameter of hole 326, although sufficient clearance is provided so that the reversing lever rotates easily in the hole. The pusher extends into the pocket in the back of the pawl, and rotation of the lever moves the pawl across compartment 318 between its two wedged positions in the same manner as discussed above with respect to the socket wrench.

Similarly to the socket wrench, the wrench illustrated in FIGS. 15A–15F may be manufactured to different sizes. The size is denoted by the size of the work piece received within the gear so that flats 350 engage and apply torque to the work piece. That is, for example, a ¼ inch wrench can turn a ¼ inch hex fastener.

As with the socket wrench, the sizes of the gear and the pawl in the ratcheting box end wrench vary with the size of the overall tool. In one preferred embodiment, the tooth depth on both the gear and the pawl is approximately 0.012 inches. As with the socket wrench, the tips of the pawl teeth define a curve having a radius that is larger than a radius of a curve defined by the troughs of the gear teeth. The ratio of the gear radius to the pawl radius for a given wrench may be determined in the same manner as described above and is preferably within range of about 1:1.08 to about 1:1.3. In one preferred embodiment of a one-quarter inch box end ratchet wrench, the gear/pawl radius ratio is about 1:1.09. In exemplary five-sixteenth, one-half, five-eighths, and three-quarter inch wrenches, the ratio in each wrench is within the range of about 1:1.08 to about 1:1.30.

As is apparent by a comparison of FIGS. 4A–4C to FIGS. 15A–15F, the socket wrench and the ratcheting box end wrench differ in the shape of their pawl compartments and in that the pawl compartment of the socket wrench is enclosed by a separate cover plate, whereas the pawl compartment of the ratcheting box end wrench is enclosed on top and bottom by the web. There is also a difference in the shape of the pawl compartments and, as described in more detail below, in the gear and pawl profiles. It should be understood, however, that these embodiments are presented by way of example only. Thus, for instance, it is possible to construct a ratcheting box end with an open pawl compartment and a socket wrench with a closed pawl compartment.

Returning to FIGS. 15A–15F, the difference in the shape of compartment 318 results in a different construction of the rear portion of the pawl. For example, compartment 318 is shallower than the compartment shown in the tool of FIGS. 4A–4C, and the pawl is therefore narrower from front to back. In addition, the curved walls of compartments 318 at areas 352 and 354, at which pawl surfaces 356 and 358 engage the compartment when the pawl is wedged between the compartment wall and the gear, define a different curve. In an alternate embodiment, however, the cutting tool flattens wall areas 352 and 354 during key-way cut so that a plane defined by each surface (i.e. a plane perpendicular to the page) defines a desired angle with respect to the tool's center line 319, as indicated in FIG. 15C. In a preferred embodiment, this angle is preferably within a range of about 27 degrees to about 35 degrees, for example approximately 31 degrees.

In addition, FIGS. 15A–15F illustrate that the gear and pawl teeth need not necessarily extend straight from the top to the bottom of the gear and pawl. In the socket wrench example discussed above, the toothed portion of the gear is cylindrical in shape. That is, if the gear is positioned so that the cylinder axis is vertical, the gear teeth extend in straight vertical lines between the opposite axial ends of the gear. Correspondingly, the pawl teeth also extend in straight vertical lines between the top and the bottom of the pawl face. As should be understood in this art, however, it is also possible to form the gear so that the gear's outer surface is concave, and the gear teeth extend vertically between the top and bottom of the gear in an inward curve. Thus, FIG. 15A, which illustrates a top view of a section of the gear taken mid-way between the gear's top and bottom ends, illustrates the gear teeth curving outward toward the gear's bottom edge. The pawl face is formed in a correspondingly convex shape so that the pawl teeth extend between the top and bottom of the pawl in an outward curve to engage with the gear teeth. Examples of a concave gear and a convex pawl are shown in FIGS. 15E and 15F.

Preferably, the pawl teeth are disposed on an arc that defines a radius of curvature greater than the radius of curvature of the gear teeth. In defining the radius of curvature ratio, the gear tooth radius of curvature and pawl tooth radius of curvature are preferably considered at a plane passing mid-way between the top and bottom halves of the gear and the pawl, as shown in FIGS. 15A–15C.

As also indicated in FIGS. 15A–15C, the center two pawl teeth may be eliminated to form a bridge 360. This does not affect the design of the teeth on either side of the bridge. For example, a full set of pawl teeth may be designed as discussed above, with an additional step of eliminating the center or, if the pawl's center line runs between two teeth instead of a single center tooth, the two center teeth. As should be understood in this art, the center teeth perform little or no work. It is believed that their removal may facilitate the pawl's ratcheting and transition movements.

Referring particularly to FIGS. 15E and 15F, a radius 700 of the arc extending between opposite axial edges of the gear and defined by the troughs between concave vertical gear teeth 52 may be equal to a radius 702 of the arc extending between top and bottom sides of the pawl face and defined by the edges of convex vertical pawl teeth 102. However, to allow for the effects of manufacturing tolerances in the alignment of the vertical teeth on the gear and the pawl, and of twisting deformation of the gear under high torque loads, the pawl's convex radius 702 is preferably less than the gear's concave radius 700. In an embodiment of a three-quarter inch ratcheting box end wrench, for example, concave gear radius 700 is about 0.236 inches, while convex pawl radius 702 is about 0.200 inches. This arrangement permits effective operation of the wrench even if the gear and/or pawl teeth are as much as about 0.020 inches out of vertical alignment. It should be understood that such a mismatch between the concave vertical gear radius and the convex vertical pawl radius may be practiced regardless of the relationship between the circumferential radii of the gear teeth and the pawl teeth. That is, the concave and convex radii of curvature may be different regardless of whether the radius defined by an arc connecting the troughs of the gear teeth is equal to or different from the radius defined by an arc connecting the tips of the pawl teeth.

Additionally, it should be understood that the concave and convex radii of curvature of the gear and the pawl, respectively, may be defined at any suitable position on the gear and the pawl that oppose each other when the pawl teeth engage the gear teeth. Thus, for example, the concave gear radius of curvature may be defined at the edge of the gear teeth while the convex pawl radius of curvature may be defined at the troughs between the pawl teeth.

Furthermore, the construction of the ratcheting tool may affect the extent of a mismatch between the concave and convex radii of curvature of the gear and the pawl. For example, a gear in a tool as shown in FIG. 15D, in which the gear is retained from the top by a C-clip, may be subject to greater twisting deformation than a gear retained from the top by the tool head itself, as in FIG. 3B, because the latter construction provides greater resistance against forces in the upward direction typically applied through the gear when the tool is in use and exhibits fewer dimensions and tolerances that affect the gear's location. Accordingly, while a mismatch between the profile radii of the gear and the pawl may occur in either arrangement, the reduced convex pawl tooth tip radius is particularly desirable in a construction in which the gear is retained from the top by a retainer other than the wrench body, such as in the embodiment shown in FIG. 15D.

As discussed above, the definition of a ratio between the gear radius and the pawl radius that is less than 1:1 (i.e., the gear radius is less than the pawl radius) facilitates the pawl's removal from the gear when the pawl transitions from one side of the pawl compartment to the other. Referring to FIGS. 13, 13A, and 14A–14C, this may also be accomplished by a pawl 400 having a shape similar to the pawl shown in FIGS. 15A–15C, primarily except that (1) the pawl teeth are disposed uniformly across the face of the pawl at a radius equal to the gear radius and (2) the pawl is formed in two halves hinged together so that the halves pivot with respect to each other. The pawl may be disposed in a compartment 410 of a wrench 412 constructed like the wrench of FIGS. 15A–15F. While the construction of the wrench is, therefore, not discussed in further detail, it should be understood that the pawl may be employed in a variety of wrench designs and may be used in other types of ratcheting tools. Thus, it should be understood that the shape of the pawl may vary to accommodate the design of the tool in which it is used and that the embodiments described herein are provided for purposes of example only.

Pawl 400 is split into two halves 414 and 416 along a line from the back of a pawl pocket 418 to a bridge 420 separating symmetric sets of pawl teeth 422 and 424 on either side of the pawl face. The cut between the two halves extends completely through the pawl, including a shelf extending rearward from a bottom area of the pawl pocket that is separated into two halves 426 and 428.

A tab extends from shelf half 428 into a corresponding groove defined in shelf half 426. The tab begins as a narrow finger and expands at its end into a circular cross-section. The tab is sized so that a small gap is left between halves 414 and 416, thereby permitting the halves to pivot slightly about the tab's circular portion. In the embodiment illustrated in FIGS. 13 and 13A, the halves may pivot by approximately ten (10) degrees. It should be understood, however, that the angle through which the halves may be allowed to pivot with respect to each other may vary and should be chosen in accordance with the design of a given tool. For example, as will become apparent below, the angle may be bounded on the high end by the shape of the back of the pawl and the shape of the pawl compartment. If the design of the pawl and/or the compartment wall is such that it is possible that the pawl's engagement with the wall could so inhibit the pawl's transition from one side of the compartment to the other, the gap between the pawl halves should be set so that the pawl halves cannot pivot to such a degree. On the low end, the pawl halves should be allowed to pivot at least such that the pawl easily disengages from the gear when transitioning from one side of the pawl compartment to the other.

The pawl halves may be allowed to pivot freely within the allowed angle. In a preferred embodiment, however, the end of the pivot tab extends upward into a cylindrical pin 430, and a spring 432 wraps around the pin so that opposing ends of the spring bias the pawl halves together. Thus, and referring to FIGS. 14A and 14C, when pawl 400 is engaged with gear 48 in one of the two wedged positions on either side of compartment 410, both sets of pawl teeth 422 and 424 engage the gear teeth.

Referring to FIG. 14C, pawl half 416 is wedged between the wall of compartment 410 and the gear and is therefore the loaded half. In this position, lever 434 is rotated so that pusher 436 engages the part of the pawl pocket at the back of half 416 so that ratcheting force is directed back through the loaded half to the pusher. As the lever is turned to transition the pawl to the other side of the compartment, the pusher's front tip moves over to half 414 and biases half 414 toward the other side of the pawl compartment and against the sides of the gear teeth. This encourages the pawl to pivot so that the teeth 422 at the leading edge of half 414 are driven into the gear teeth, while teeth 424 of the loaded side are biased away from the gear teeth. Because the pawl halves can pivot with respect to each other about pin 430 (FIG. 13), the reaction force between the gear teeth and teeth 424 on pawl half 416 causes half 416 to pivot slightly with respect to half 414, thereby facilitating disengagement of teeth 424 from the gear teeth. As half 416 moves away from the gear teeth, teeth 422 ride up the gear teeth until the pawl teeth clear the gear teeth, as shown in FIG. 14B, and the pawl transitions to the opposite wedged position shown in FIG. 14A.

Referring again to FIG. 13, the top of pin 430 is low enough so that the pusher may swing across the pawl pocket without interference from the pin. In the embodiment illustrated in FIGS. 16A–16C, the pivot pin remains below the path of the pusher (not shown) but is aligned parallel to the pawl face. More specifically, pawl 500 includes two halves 502 and 504 on which are defined symmetric sets of pawl teeth 506 and 508 that, when the pawl engages the gear, define a common radius with the gear teeth. Pawl half 502 includes a tab 514 that extends into a notch formed in half 504. Tab 514 includes a cylindrical through-hole 516 that receives a cylindrical pin 520 extending up from pawl half 504 so that the pawl halves may pivot with respect to each other about the pin. Tab 14 extends a distance from pawl half 502 so that a gap 522 between the halves permits the halves to pivot to a desired angle. A coil spring 521 wraps around pin 520 so that opposing ends of spring 521 bias the pawl halves toward the gear. The pusher tip (not shown) engages, and moves between, pawl pocket sides 510 and 512 above pin 520 and tab 514. The operation of pawl 500 in the wrench is the same as discussed above with respect to FIGS. 14A–14C.

FIGS. 25 and 26 illustrate a socket wrench similar to the wrench in FIGS. 2, 3A and 3B, except that the teeth of gear 852 and pawl 850 are curved in the vertical direction as described above with respect to FIGS. 15E and 15F. Gear 852 is formed by selecting a gear blank with a smooth cylindrical outer surface and machining a vertical curve around the gear blank's outer perimeter, the machined surface forming the top, or radially outward, edges of the gear teeth. A circular cutter then cuts the troughs between the gear teeth. The resulting teeth have curved edges along their vertical face 851, curved troughs between teeth, and a uniform tooth depth between adjacent teeth along the entire vertical width of the teeth.

FIG. 27 illustrates a ratcheting box end wrench 858 with vertically curved gear/pawl teeth as discussed above with respect to FIGS. 15A–15F. Box end wrench 858 is preferably sufficiently thin so that the wrench can fit in tight places. In this particular wrench, an open end 856 is included at the opposite end of the wrench. Alternatively, a second ratcheting wrench end, or a non-ratcheting box end, or a simple handle could be included instead of open end 856. Although different reference numbers are used in FIGS. 15 and 27, this is for convenience of description only.

The tool head includes a gear bore 882 concentric about a centerline 880. A gear 876 fits within gear bore 882, with a top rim of gear 876 bearing against a bearing surface 878 of gear bore 882. A web portion 860 connects the head and handle and defines a pawl pocket 884 (not visible in the Figure) in which a pawl is disposed. The web also defines a hole 864 that receives a lever 868 having a spring 870 and pusher 872 received within hole 864 so that pusher 872 urges pawl 874 into opposite sides of pawl pocket 884, depending on the position of lever 868. An O-ring 866 helps provide a tight fit between lever 868 and the tool's neck portion.

FIG. 28 is a cross-sectional view of the head of wrench 858. Pawl 874 is not shown in section to thereby illustrate the vertical curvature of pawl teeth 888 from a top view. The pawl in FIG. 29, however, is shown cut through the center of the pawl, as is the rest of the tool's head in FIG. 29.

As should be understood in this art, the dimensions of gear teeth 882 and pawl teeth 888 affect the tool's strength and functionality. For example, increasing the number of gear teeth around the gear's circumference allows the tool to ratchet with a smaller angular deflection of the tool. This fine "pitch" allows the tool to ratchet in tighter spaces than a wrench with fewer teeth. Prior to adjustments for variations in the horizontal radii of the gear and pawl teeth discussed above, the included and adjacent angles (discussed above) of the pawl teeth are preferably initially assumed to be the same as the adjacent and included angles of the gear teeth, respectively. While the included/adjacent angles depend on tooth depth, the pawl tooth adjacent angle in a preferred embodiment is about ninety degrees, while the pawl tooth included angle is about 84 degrees. The gear tooth adjacent and included angles are approximately the same as, but the reverse of, the pawl tooth angles. It should be understood, however, that these angles may vary as desired.

Regardless of a ratcheting tool's given gear and pawl widths (or gear and pawl tooth widths), number of teeth, tooth depth, and included and adjacent angles, the tool's gear and pawl may have straight or curved teeth in the vertical direction. Straight teeth may be formed by broaching or other suitable procedures that typically make a cut axially along the gear's outer surface. The provision of bearing surfaces about the top and/or bottom of the gear, however, generally add manufacturing steps to the production of straight teeth. Vertically curved teeth in a gear, however, may be formed (as discussed above) by bringing a cutting disc into contact with the exterior of a standard gear blank, removing the need for an extra step to form a bearing surface about the top or bottom of the gear.

As should also be understood, the depth of the teeth may be bounded by operational concerns. Reduction in tooth depth, for example, reduces the engagement area between the gear and pawl teeth and, therefore, reduces strength. On the other hand, if the teeth are too deep, for example more than about 0.028 inches, the pawl and gear may not sufficiently disengage during ratcheting or not ratchet smoothly. Preferably, the teeth have a depth of between about 0.012 inches and about 0.025 inches. It should be understood, however, that the overall rated size of the wrench or the socket wrench may affect tooth depth, included angle, and number of teeth in that tools of varying sizes may have varying gear radii.

The vertical width of the gear and the pawl may also affect tool strength. As used herein, the "width" of the gear and pawl teeth refers to the straight-line distance between opposite vertical ends of the teeth. Functional considerations, such as the desire to fit a wrench in tight spaces, favor a thin width of the wrench and, therefore, short arc gear and pawl teeth. A thin wrench may also lower the cost of the tool, since a thin wrench requires less material.

The width of the gear teeth may be less than the width of the gear itself. As noted above, for example, bearing surfaces may be provided on the gear above and below the gear teeth. Furthermore, pawl tooth width is, in general, slightly less than gear tooth width. In a preferred embodiment, pawl tooth width is between about 0.130 inches and about 0.220 inches, with the gear tooth width being slightly wider.

The vertical radii of curvature of the pawl and the gear may be bounded by geometric and practical considerations. When a constant-radius curve over the full tooth width is desired, for example, the vertical radius of curvature of the gear or the pawl cannot be smaller than one-half the tooth width. Conversely, a large vertical radii may interfere with the sizing of other wrench components. Preferably, the vertical radii of the gear teeth and the pawl teeth are within a range of about 0.2 inches to about 0.3 inches, although radii beyond this range could be used.

When the gear teeth and the pawl teeth are curved in the vertical direction, a vertical offset between the gear and the pawl can cause a greater disengagement between the gear and pawl teeth than if the teeth were vertically straight. In general, the vertical "offset" refers to an offset vertically between a horizontal plane bisecting the pawl teeth and a horizontal plane bisecting the gear teeth when torque is applied to the wrench. When the wrench is unloaded, the centerlines of the gear and the pawl may appear to be aligned with one another. As torque is applied to a wrench having vertically curved gear teeth and pawl teeth when the gear is secured to a workpiece, tolerances in component dimensions and deformation in the retaining C-ring may allow or cause the gear to shift vertically with respect to the pawl. If the curves of the gear teeth and the pawl teeth are equal, as described in more detail below, an offset can cause an edge of the pawl teeth to engage against an edge of the gear teeth. When this occurs, an increasingly large amount of the pawl teeth at the pawl's opposite end moves out of engagement with the gear teeth. This reduces the area of engagement between the gear teeth and the pawl teeth, while the areas that remain in engagement are predominantly toward the tooth edges, thereby reducing the strength of the engagement between the gear and the pawl. It is believed that the vertical offset in most wrenches is normally about 0.020 inches or less.

Figure 30A:
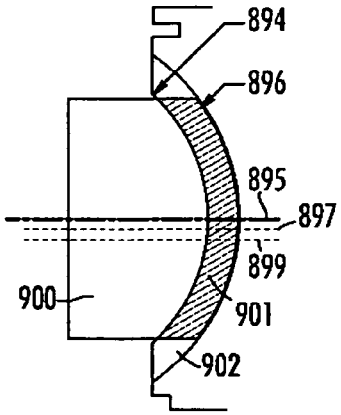
FIG. 30A (Prior Art)

FIG. 30A schematically illustrates a pawl 900 with teeth having a vertical radius of curvature the same as that of the gear teeth. The pawl teeth are fully engaged with gear teeth 902, and the area between the edges 894 of gear teeth 902 and pawl teeth edges 896 (which are received in the troughs between the gear teeth) is the area of engagement shaded at 901. Centerline 895 represents the centerline of both the gear and the pawl in this configuration in which the gear and the pawl are fully engaged with each other. The gear and pawl teeth in FIG. 30A are approximately 0.025 inches deep.

Figure 30D:
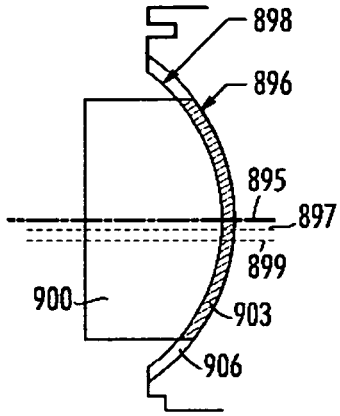
FIG. 30D (Prior Art)
Figure 30B:
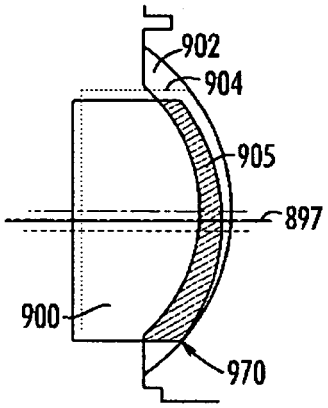
FIG. 30B (Prior Art)

In FIG. 30B, pawl 900 is vertically offset 0.010 inches so that the pawl centerline moves to 897 while the gear centerline remains at 895. The pawl's former position (shown in FIG. 30A) is indicated at 904. As pawl 900 moves downward, a bottom corner 970 of the pawl teeth (one of which is shown in FIG. 30B) moves down the curved trough between the gear teeth, thereby pushing the pawl back away from the gear so that the area of engagement between the gear teeth and the pawl teeth reduces to shaded area 905 from shaded area 901 in FIG. 30A. FIG. 30C shows the same gear teeth 902 and pawl 900, where the pawl is offset 0.020 inches to centerline 899. The area of engagement 909 in FIG. 30C is smaller still than the area of engagement 905 in FIG. 30B.

Figure 30E:
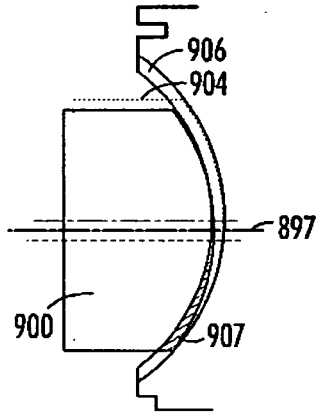
FIG. 30E (Prior Art)
Figure 30C:
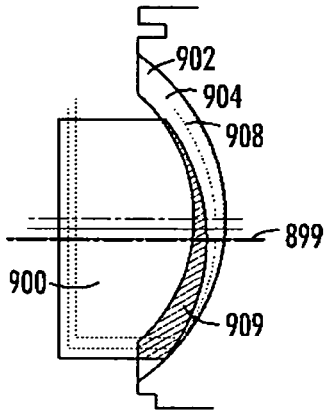
FIG. 30C (Prior Art)
Figure 30F:
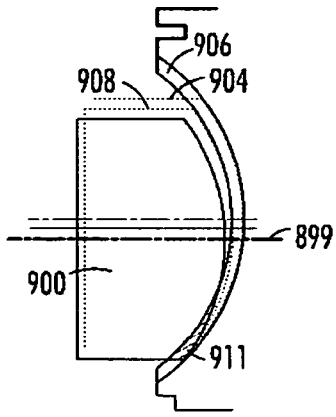
FIG. 30F (Prior Art)

FIGS. 30D through 30F show the same progression of offsets (0, 0.010, and 0.020 inches) for a gear and a pawl having a tooth depth of 0.012 inches.

Figure 31A:
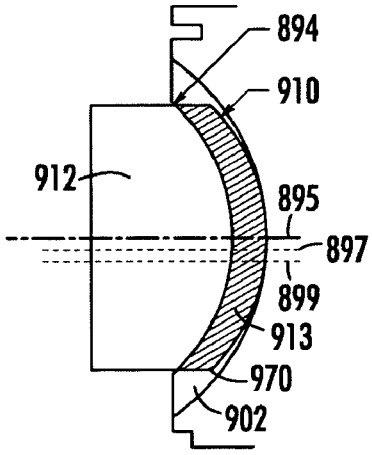
Figure 31D:
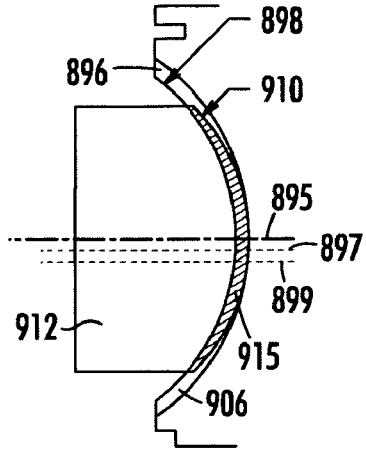
Figure 31B:
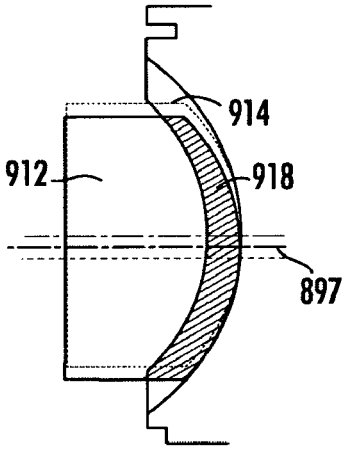
Figure 31E:
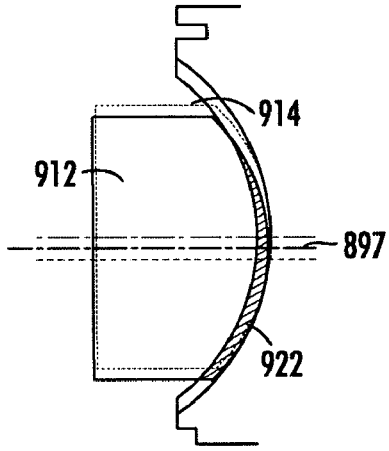
Figure 31C:
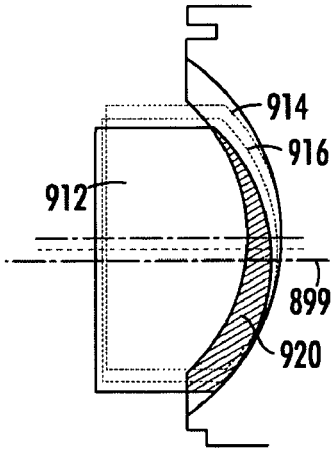

FIGS. 31A through 31C schematically illustrate a pawl and gear as in the wrenches of FIGS. 25 and 27, in which the pawl tooth radius of curvature is less than the gear tooth radius of curvature, as described above with respect to FIGS. 15E and 15F. The troughs between gear teeth 902 have the same radius as in FIG. 30, but the vertical radius of curvature of tooth edges 910 of pawl 912 is slightly smaller than the vertical radius of curvature of pawl tooth edges 896 in FIG. 30A. The gear and pawl teeth are approximately 0.020 inches deep. Centerline 895 represents the centerline of both the gear and the pawl in this configuration where both the gear and the pawl are fully engaged. Thus, shaded area 913 is the area of engagement at zero offset. Centerline 897 represents a centerline that is 0.010 inches offset from centerline 895. Centerline 899 represents a centerline that is 0.020 inches offset from centerline 895.

FIG. 31B shows the pawl 912 of FIG. 31A vertically offset by 0.010 inches with respect to the gear. The progression of FIGS. 31A through 31F follows the same pattern as that of previous FIGS. 30A through 30C, as the pawl offsets vertically with respect to the gear and the pawl centerline moves to 897 and 899.

Comparing FIG. 30A to FIG. 31A, engagement area 901 is larger than engagement area 913. That is, when the pawl fully engages the gear, a common vertical radius for the gear teeth and the pawl teeth results in greater surface area engagement than when the pawl teeth vertical radius of curvature is smaller than that of the gear teeth. As relative offsets occur between the pawl and the gear, however, engagement areas 918 and 920 in FIGS. 31B and 31C are greater than engagement areas 905 and 909 in FIGS. 30B and 30C, respectively. Because of the smaller pawl tooth curvature radius, bottom corner 970 of the pawl tooth is spaced slightly from the gear tooth trough. The pawl therefore does not push away as rapidly from the gear as in the configuration of FIG. 30, and the gear teeth and pawl teeth enjoy a greater surface area engagement, at a greater depth into the tooth troughs, as the gear and pawl offset.

Figure 31F:
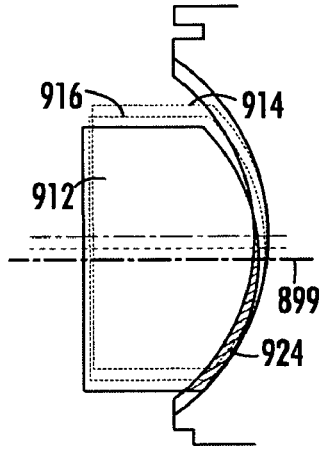

FIGS. 31D through 31F show the same progression of areas of engagement as in FIGS. 31A through 31C, except that the depth of the gear teeth is shallower.

In FIGS. 32A through 32C, the same progression of pawl offsets (0, 0.010, and 0.020 inches) is shown for a pawl 928 having a yet smaller vertical radius of curvature than in FIGS. 31A through 31F. In the fully engaged position of FIG. 32A, the pawl with a smaller vertical radius of curvature has an engagement area smaller than engagement area 901 in FIG. 30A for a pawl having the same vertical radius of curvature as the gear. However, the engagement areas 934 and 938 in FIGS. 32B and 32C are larger than the corresponding engagement areas 905 and 909 in FIGS. 30B and 30C. In addition, the pawl teeth at engagement area 938 at the 0.020 offset position in FIG. 32C, engage an area of the gear teeth closer to centerline 895 of the gear teeth. That is, the pawl teeth engage a deeper area of the gear teeth when compared to the engagement area 909 in FIG. 30C. It is therefore believed that FIG. 32C illustrates a stronger gear/pawl interface than that shown in FIG. 30C.

FIGS. 32D through 32F show the same progression of areas of engagement as in FIGS. 32A through 32C, except that the depth of the gear teeth is shallower.

As indicated above, a pawl with teeth having a smaller radius of curvature than the gear teeth has a smaller engagement area at full engagement than a gear and pawl with the same vertical radius of curvature but has a greater engagement area as offsets occur. Generally, the improved performance at offset is believed to compensate for the smaller engagement area at full alignment. At some point, however, the reduction in pawl vertical radius results in an unacceptable reduction of engagement area at zero offset. The point at which this occurs may depend upon the particular arrangement and dimensions of the wrench. For the illustrated embodiments, at the dimensions and ratios discussed herein, the engagement area at full alignment for a reduced vertical radius pawl preferably is not be less than about 80% of the engagement area that would occur at full alignment if the pawl vertical radius were equal to the gear vertical radius.

FIGS. 34 and 35 describes the percent engagement of gear teeth and pawl teeth at full alignment (0.000 offset) and at vertical offsets of 0.005, 0.010, 0.015 and 0.020 inches (and average), where the gear's vertical radius of curvature is constant at 0.200 inches. In addition, each section of the table shows the percent engagement at these offsets for a pawl having a given vertical radius of curvature ranging from 0.110 inches (i.e., the pawl's vertical radius of curvature equals the gear's radius of curvature) to 0.200 inches. The horizontal diameter of the gear is appropriate for a standard 8 millimeter wrench and is constant in this particular set of data. The analysis assumes that the gear moves only vertically with respect to the pawl and that the components do not deform. While the components would therefore behave somewhat differently under actual loads, it is believed that the table illustrates the effects of varying the pawl tooth vertical radius of curvature. Furthermore, as noted above, there may be a difference between the horizontal radii of curvature between the gear and the pawl. This does not affect the table, however, in that the engagement area is assumed to be at the pawl's primary load bearing tooth, i.e, the tooth that is the most fully engaged with the gear when torque is applied to the wrench.

Referring to the top left section of Table 1, when the pawl and the gear have the same vertical radius of curvature, the percent engagement of the primary load bearing tooth is 100% at zero offset between the gear and pawl. This is the baseline from which the other measurements are made. That is, the percentages represented in the graphs are percentages of what the engagement area would be if the gear and pawl radius of curvature were the same and at zero offset. To calculate a percentage engagement area for a given offset, one would merely divide the tooth engagement area at the given offset by the baseline value (i.e., same radius of curvature, zero offset).

As noted above, the first set of bars in the graph show the arrangement where the concave gear radius of curvature is equal to the convex pawl radius of curvature. In addition to the condition of zero offset, offsets of 0.005, 0.010, 0.015, and 0.020 inches (and average) are shown. Along the X-axis are groups of bars at different pawl radii of curvature. Within each group are bars representing the percentage engagement at zero offset, 0.005 inches offset, 0.010 inches offset, 0.015 inches offset, 0.020 inches offset, and the average percentage engagement over all the offsets.

The tables and graphs shown in FIGS. 36 through 39 are similar to those shown in FIGS. 34 and 35, except that they represent different sized radii of curvature. FIGS.36 through 39 correspond to wrenches with a concave gear radius of curvature of 0.300 inches rather than the 0.200 inches gear radius of curvature in FIGS. 34 and 35.

For the embodiments discussed herein, and with reference to FIGS. 34 through 39, it has been found that the average engagement area is at a relatively high level, while at the same time the loss of engagement area at full alignment is desirably low, when the pawl vertical radius of curvature is about 65% to about 90% of the gear vertical radius of curvature, with ratios in the range of about 75% to about 90% being preferred. Of course, the radius ratio may be less than about 60% or more than about 90% if desired. The ratio in a given instance will depend on the wrench and on the desired performance.

While the mismatch between a pawl's vertical radii of curvature and an opposing gear is discussed herein primarily with respect to a wrench having an externally toothed gear, the present invention may be utilized in other arrangements. Referring now to FIG. 33, for example, a socket wrench is shown with vertically curved teeth 956 formed on the inner circumference of a head 954 of the wrench forging. A pawl 952 fits between a bearing plate 960 and a top plate 948. A ring 950 positions pawl 952 within the wrench and works as a spring to allow the pawl to ratchet. A spring 968 is received in a blind bore 963. A ball 964 is received in the bore over the spring so that the spring biases the ball outward from the bore. The bore's edges are peened to retain the ball so that the ball only partially extends out of the bore. Sufficient pressure on ball 964 by a socket (not shown) causes ball 964 to depress and retain the socket over extension portion 962. A screw 946 received in a threaded bore 958 holds plate 948 to bearing plate 960. In this configuration, the vertically curved teeth 956 on the inner circumference of gear head 954 interact with the vertically curved teeth of pawl 952 to ratchet in one direction but transmit torque in the other. The vertical radius of curvature of the convex teeth of pawl 952 may be less than the vertical radius of curvature of concave pawl teeth 956.

The radius ratio of the pawl radius and gear radius in the horizontal plane does not affect the design of the pawl and gear's vertical radius of curvature. As stated earlier, it is desirable to have the pawl's horizontal radius larger than the gear's radius, preferably having a pawl teeth tip radius to gear teeth trough radius within a range of about 1:1.08 to about 1:1.3. To achieve this condition, the geometry of the pawl teeth may need to be adjusted according to the steps set forth earlier in this specification. It is believed that any changes made to the design of the pawl's teeth in the horizontal plane will not affect the selection of a vertical radius of curvature mismatch between the pawl and the gear. The design of the pawl in the horizontal plane could be performed before or after the design of the vertical radius of curvature mismatch because one design is not believed to be dependent on the other. Including both horizontal plane adjustments to the pawl and a vertical radius of curvature mismatch is thought to provide a tool with the benefits of both improvements.

Once dimensions are selected for a pawl and pawl pocket of a given sized wrench (e.g., 17 mm), the same pawl and pawl pocket may be used for near but different sized wrenches (e.g., 16 mm and 18 mm), thereby reducing the tooling and re-tooling costs to manufacture the other tools. Generally, the radius ratio between the pawl and the gear in the horizontal plane (with the pawl having a larger horizontal radius than the gear) allows one pawl and pawl pocket to perform effectively with two or more similar sized wrenches. That is, wrenches with different but similar sized gears may be able to use the same pawl/pawl pocket arrangements. The pawl's tolerances, however, will only allow for a certain amount of variance in the gear's size. For example, the pawl's radius in the horizontal plane cannot be smaller than the gear's radius. On the other end of the spectrum, if the pawl's radius in the horizontal plane is too large when compared with the gear's radius, the tool will not function properly, and the pawl pocket may not fit in the neck portion of the tool. For pawl radii between these two extremes, using the same pawl and pawl pocket in different similar-sized wrenches may reduce tooling costs.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope of the appended claims.

What is claimed is:

1. A ratcheting tool, said ratcheting tool comprising:

a body;

a compartment defined by the body;

a gear rotatably disposed in the compartment about an axis and defining a plurality of teeth having respective edges aligned generally parallel to the axis on a circumference of the gear; and a pawl defining a plurality of teeth with respective edges aligned generally parallel to the axis and facing the gear so that the gear teeth and the pawl teeth are engagable with each other at an engagement area of the gear teeth and an engagement area of the pawl teeth, wherein the pawl is disposed between the gear and the body so that the body transmits torque through the pawl in a first rotational direction and so that the pawl ratchets with respect to the gear in a second rotational direction, wherein the edges of one of the gear teeth and the pawl teeth are concave at one of the engagement area of the gear teeth and the engagement area of pawl teeth, and the edges of the other of the gear teeth and the pawl teeth are convex at the other of the engagement area of the gear teeth and the engagement area of the pawl teeth, and wherein a radius of curvature of the concave edges of the one of the gear teeth and pawl teeth is greater than a radius of curvature of the convex edges of the other of the gear teeth and pawl teeth.

2. A ratcheting tool as in claim 1, wherein the edges of the gear teeth are concave at the engagement area of the gear teeth and the edges of the pawl teeth are convex at the engagement area of the pawl teeth.

3. The ratcheting tool as in claim 2, wherein the circumference of the gear is an outer circumference of the gear.

4. The ratcheting tool as in claim 3, wherein the width of the pawl teeth is within a range of about 0.130 inches to about 0.220 inches.

5. The ratcheting tool as in claim 3, wherein a depth of the gear teeth is a radial distance between an arc defined by the edges of the gear teeth and an arc defined by troughs between adjacent gear teeth, wherein a depth of the pawl teeth is a radial distance between an arc defined by the edges of the pawl teeth and an arc defined by troughs between adjacent pawl teeth, and wherein the gear teeth depth equals the pawl teeth depth.

6. The ratcheting tool as in claim 5, wherein the depth of the pawl teeth and the depth of the gear teeth are within a range of about 0.012 inches to about 0.020 inches.

7. The ratcheting tool as in claim 3, wherein the gear teeth radius of curvature is within a range of about 0.2 inches to about 0.3 inches.

8. The ratcheting tool as in claim 3, wherein a ratio of the pawl teeth radius of curvature to the gear teeth radius of curvature is within a range of about 0.75 to about 0.90.

9. The ratcheting tool as in claim 3, wherein each of the gear teeth defines an included angle between opposing sides of the gear teeth, wherein each of the pawl teeth defines an included angle between opposing sides of the pawl teeth, and wherein the included angle of the gear teeth and the adjacent angle of the pawl teeth is about ninety degrees.

10. A ratcheting tool, said ratcheting tool comprising:

a body having a head and an elongated arm attached to the head;

a first compartment defined by the head;

a second compartment defined by the body and opening to the first compartment;

a gear rotatably disposed in the first compartment about an axis and defining a plurality of teeth having respective edges aligned generally parallel to the axis on an outer circumference of the gear;

a pawl defining a plurality of teeth with respective edges aligned generally parallel to the axis and facing the gear so that the gear teeth and the pawl teeth are engagable with each other at an engagement area of the gear teeth and an engagement area of the pawl teeth; and wherein the pawl is disposed in the second compartment so that the body transmits torque through the pawl in a first rotational direction and so that the pawl ratchets with respect to the gear in a second rotational direction, wherein the edges of the gear teeth are concave at the engagement area of the gear teeth, wherein the edges of the pawl teeth are convex at the engagement area of the pawl teeth, and wherein a radius of curvature of the concave edges of the gear teeth is greater than a radius of curvature of the convex edges of the pawl teeth.

11. The ratcheting tool as in claim 10, wherein the width of the pawl teeth is within a range of about 0.130 inches to about 0.220 inches.

12. The ratcheting tool as in claim 10, wherein a depth of the gear teeth is a radial distance between an arc defined by the edges of the gear teeth and an arc defined by troughs between adjacent gear teeth, wherein a depth of the pawl teeth is a radial distance between an arc defined by the edges of the pawl teeth and an arc defined by troughs between adjacent pawl teeth, and wherein the gear teeth depth equals the pawl teeth depth.

13. The ratcheting tool as in claim 12, wherein the depth of the pawl teeth and the depth of the gear teeth are within a range of about 0.012 inches to about 0.025 inches.

14. The ratcheting tool as in claim 10, wherein the gear teeth radius of curvature is within a range of about 0.2 inches to about 0.3 inches.

15. The ratcheting tool as in claim 10, wherein a ratio of the pawl teeth radius of curvature to the gear teeth radius of curvature is within a range of about 0.75 to about 0.90.

16. The ratcheting tool as in claim 10, wherein each of the gear teeth defines an included angle between opposing sides of the gear teeth, wherein each of the pawl teeth defines an included angle between opposing sides of the pawl teeth, and wherein the included angle of the gear teeth and the adjacent angle of the pawl teeth is about ninety degrees.

17. A ratcheting tool, said ratcheting tool comprising:

a body having a head and an elongated arm attached to the head;

a first compartment defined by the head;

a second compartment defined by the body and opening to the first compartment;

a gear rotatably disposed in the first compartment about an axis and defining a plurality of teeth having respective edges aligned generally parallel to the axis on an outer circumference of the gear; and a pawl defining a plurality of teeth with respective edges aligned generally parallel to the axis and facing the gear so that the gear teeth and the pawl teeth are engagable with each other at an engagement area of the gear teeth and an engagement area of the pawl teeth, wherein the pawl is disposed in the second compartment so that the pawl is slidable across the second compartment laterally with respect to the gear between a first position in which the pawl is disposed between the body and the gear so that the body transmits torque through the pawl in a first rotational direction and ratchets in an opposite rotational direction and a second position in which the pawl is disposed between the body and the gear so that the body transmits torque through the pawl in the opposite rotational direction and ratchets in the first rotational direction, wherein the edges of the gear teeth are concave at the engagement area of the gear teeth, wherein the edges of the pawl teeth are convex at the engagement area of the pawl teeth, and wherein a radius of curvature of the concave edges of the gear teeth is greater than a radius of curvature of the convex edges of the pawl teeth.

18. The ratcheting tool as in claim 17, wherein the edges of the concave gear teeth at the gear teeth engagement area are defined on a single radius, and wherein the edges of the convex pawl teeth at the pawl teeth engagement area are defined on a single radius.

19. The ratcheting tool as in claim 17, wherein the pawl teeth and the gear teeth have respective widths defined by the straight-line axial distance between respective opposite ends of the gear teeth and the pawl teeth, the width of the pawl teeth being less than the width of the gear teeth.

20. The ratcheting tool as in claim 19, wherein the width of the pawl teeth is within a range of about 0.130 inches to about 0.220 inches.

21. The ratcheting tool as in claim 17, wherein a depth of the gear teeth is a radial distance between an arc defined by the edges of the gear teeth and an arc defined by troughs between adjacent gear teeth, wherein a depth of the pawl teeth is a radial distance between an arc defined by the edges of the pawl teeth and an arc defined by troughs between adjacent pawl teeth, and wherein the depth of the gear teeth equals the depth of the pawl teeth.

22. The ratcheting tool as in claim 21, wherein the depth of the pawl teeth and the depth of the gear teeth are within a range of about 0.012 inches to about 0.025 inches.

23. The ratcheting tool as in claim 17, wherein the gear teeth radius of curvature is within a range of about 0.2 inches to about 0.3 inches.

24. The ratcheting tool as in claim 17, wherein a ratio of the pawl teeth radius of curvature to the gear teeth radius of curvature is within a range of about 0.75 to about 0.90.

25. The ratcheting tool as in claim 17, wherein each of the gear teeth defines an included angle between opposing sides of the gear teeth, wherein each of the pawl teeth defines an adjacent angle between opposing sides of the pawl teeth, and wherein the included angle of the gear teeth and the adjacent angle of the pawl teeth is about ninety degrees.

26. A ratcheting tool, said ratcheting tool comprising:

a body having a head and an elongated arm attached to the head;

a first compartment defined by the head;

a second compartment defined by the body and opening to the first compartment;

a gear rotatably disposed in the first compartment about an axis and defining a plurality of teeth having respective edges aligned generally parallel to the axis on an outer circumference of the gear; and a pawl defining a plurality of teeth with respective edges aligned generally parallel to the axis and facing the gear so that the gear teeth and the pawl teeth are engagable with each other at an engagement area of the gear teeth and an engagement area of the pawl teeth, wherein the pawl is disposed in the second compartment so that the pawl is slidable across the second compartment laterally with respect to the gear between a first position in which the pawl is disposed between the body and the gear so that the body transmits torque through the pawl in a first rotational direction and ratchets in an opposite rotational direction and a second position in which the pawl is disposed between the body and the gear so that the body transmits torque through the pawl in the opposite rotational direction and ratchets in the first rotational direction, wherein the edges of the gear teeth are concave at the engagement area of the gear teeth, wherein the edges of the pawl teeth are convex at the engagement area of the pawl teeth, wherein a radius of curvature of the concave edges of the gear teeth is greater than a radius of curvature of the convex edges of the pawl teeth, wherein the width of the pawl teeth is within the range of about 0.130 inches to about 0.220 inches, wherein the depth of the pawl teeth and the depth of the gear teeth are within a range of about 0.012 inches to about 0.025 inches, and wherein a ratio of the pawl teeth radius of curvature to the gear teeth radius of curvature is within a range of about 0.75 to about 0.90.

* * * * *